US008448284B2

(12) United States Patent
Gross et al.

(10) Patent No.: US 8,448,284 B2
(45) Date of Patent: May 28, 2013

(54) TOOTHBRUSH WITH FACETED HANDLE

(75) Inventors: Peter Gross, Sempach (CH); Martin Zwimpfer, Luzern (CH)

(73) Assignee: Trisa Holding AG, Triengen (CH)

( * ) Notice: Subject to any disclaimer, the term of this patent is extended or adjusted under 35 U.S.C. 154(b) by 1217 days.

(21) Appl. No.: 12/225,121

(22) PCT Filed: Mar. 23, 2007

(86) PCT No.: PCT/EP2007/002610
§ 371 (c)(1),
(2), (4) Date: Oct. 28, 2008

(87) PCT Pub. No.: WO2007/110208
PCT Pub. Date: Oct. 4, 2007

(65) Prior Publication Data

US 2009/0183331 A1 Jul. 23, 2009

(30) Foreign Application Priority Data

Mar. 24, 2006 (EP) ..... 06006099

(51) Int. Cl.
*A46B 5/02* (2006.01)
*A46B 9/04* (2006.01)

(52) U.S. Cl.
USPC ..... 15/143.1; 15/167.1

(58) Field of Classification Search
USPC ..... 15/143.1, 167.1
See application file for complete search history.

(56) References Cited

U.S. PATENT DOCUMENTS

| | | | | |
|---|---|---|---|---|
| 2,130,661 | A * | 9/1938 | Zaebst | 15/167.1 |
| 2,304,319 | A * | 12/1942 | Saltzman | 15/167.1 |
| 2,651,068 | A * | 9/1953 | Seko | 15/111 |
| 3,971,094 | A * | 7/1976 | Solf et al. | 15/143.1 |
| 2002/0056197 | A1 | 5/2002 | Johnson | |
| 2003/0221272 | A1 * | 12/2003 | Lehman | 15/167.1 |
| 2004/0255416 | A1 | 12/2004 | Hohlbein | |
| 2006/0213018 | A1 | 9/2006 | Gross et al. | |

FOREIGN PATENT DOCUMENTS

| | | |
|---|---|---|
| EP | 1 532 891 A1 | 5/2005 |
| FR | 2 768 908 | 4/1999 |

* cited by examiner

*Primary Examiner* — Randall Chin
(74) *Attorney, Agent, or Firm* — Oliff & Berridge, PLC

(57) ABSTRACT

The toothbrush according to the invention is equipped with a handle of which the surface is formed, at least in certain sections, in a facet-like manner by way of multiplicity of planar surface-area elements. The surface-area elements are arranged directly adjacent to one another and form a network of element edges. The multiplicity of surface-area elements reproduce, more or less, an essentially rounded handle form, this ensuring comfortable use of the toothbrush in different rotary positions in relation to its longitudinal axis.

22 Claims, 10 Drawing Sheets

TOOTHBRUSH WITH FACETED HANDLE

The present invention relates to a toothbrush.

TECHNICAL FIELD

Toothbrushes are generally known articles for cleaning the oral cavity, in particular the teeth and the tongue, and serve in this sense for oral hygiene.

BACKGROUND ART

A toothbrush is described, for example, in the patent U.S. Pat. No. 2,130,661. The toothbrush is provided with an elongate handle, a neck adjoining the handle in the longitudinal direction and a head adjoining the neck opposite from the handle. The head is covered on one side with bristles. The surface of the handle has trapezoidal surface-area elements in three longitudinal portions respectively adjoining one another. The circumferentially adjacent surface-area elements of one longitudinal portion are arranged rotationally symmetrically with respect to the longitudinal axis of the handle and, in a cross section perpendicular to the longitudinal axis of the handle, form regular octagons. Starting from the free end of the handle and proceeding in the direction of the head, the cross section of the handle initially narrows and then widens once again up to a thumb rest, to subsequently narrow once again toward the neck.

DISCLOSURE OF THE INVENTION

The object of the present invention is to provide a toothbrush comprising an ergonomically particularly advantageous handle for comfortable handling of the toothbrush that is conducive to cleaning.

Particularly preferred embodiments are provided with the features presented in the dependent claims.

The subject matter of the present invention has an elongate handle, a neck adjoining the latter on one side and a head arranged on the neck opposite from the handle. According to the invention, at least one portion of the surface of the handle is provided with a multiplicity of at least approximately planar surface-area elements. The surface-area elements are respectively arranged adjacent one another and directly adjoin one another to form element edges. The surface-area elements are arranged on the surface in a facet-like manner, whereby an essentially rounded handle form is at least approximately reproduced. The element edges thereby form a network-like surface structure on the handle. Apart from portions with at least approximately planar surface-area elements, the surface of the handle may also have continuously smooth surface portions.

The rounded handle form represents an ergonomically advantageous adaptation to match the likewise roundly curved inner surface of the hand of the user and prevents pressure points from forming. At the same time, the many surface-area elements thereby form a multiplicity of resting surfaces for the hand, so that comfortable use of the toothbrush in different rotary positions in relation to its longitudinal axis is ensured. This in turn is conducive to a circular cleaning motion, requiring different rotational positions, for the gentle and thorough cleaning of the teeth.

The individual surface-area elements, which are in a predetermined angular position with respect to the bristle zone, likewise allow the user to assume a number of advantageous holding positions with his hand, in order to improve the cleaning performance of the bristle zone. Individual preferred holding positions are in this case formed by the surface-area elements.

It may be particularly desired for this reason to form a control element, comprising surface-area elements described. This is preferably positioned on the handle or at the transition between the handle and the neck.

During the use of the toothbrush, the element edges between the surface-area elements bring about the formation of on the one hand contact lines with the inner surface of the hand and on the other hand clearances between the surface of the handle and the inner surface of the hand, so as to be conducive to the flowing away of liquids between the inner surface of the hand and the surface of the handle. In this way, the risk of the hand slipping from the toothbrush is reduced, and consequently more secure handling is made possible.

In a preferred embodiment, element edges adjoining one another may form a contiguous edge line, which wraps around the handle in the surface portion formed by the surface-area elements. The edge line is preferably spirally formed, at least in certain portions.

The handle surface formed by the surface-area elements makes optimum gripping possible both for right-handed and left-handed people and for larger and smaller hands. During cleaning, changing handle holding positions with the same comfort are offered for the user. A large number of secure handle holding positions are made possible by the multiplicity of resting surfaces formed by the surface-area elements.

The toothbrush according to the invention consequently offers optimized and comfortable handling in different rotary positions of the toothbrush for different users with an ergonomically rounded handle form and an advantageous drainage system for liquids getting between the surface of the handle and the inner surface of the hand. With the formation of a control element, comprising surface-area elements, the user can also be provided with advantageous holding positions to maximize the cleaning performance.

The aforementioned continuously smooth surface portions are preferably used wherever the feel and the friction between the surface and the inner surface of the hand are less important or may be disruptive in the cleaning process. In particular, the neck of the brush may preferably be of a continuously smooth configuration.

Furthermore, with a crystal- or diamond-like arrangement of the surface-area elements and use of transparent or translucent materials for the handle, particularly striking visual properties are obtained for the toothbrush, enhancing its recognizability, increasing its distinctiveness and allowing improved inferences about the time for its replacement or cleaning to be made on the basis of the change in its visual properties, for example as a result of wear, such as for example scratching, and/or soiling.

In a further embodiment, additional active light sources, such as for example light emitting diodes (LEDs) or incandescent bulbs may be used. The multiplicity of surface-area elements, as well as inner surface areas or surfaces, may serve the purpose of deflecting the generated light to specific locations by reflection and refraction. Important elements and locations on the toothbrush (for example active cleaning zones in the head, decisive holding zones on the handle, tongue-cleaning elements, etc.) can be visually indicated to the user in this way.

In addition, the handle may be of a hollow form in certain portions. Inner surfaces of this hollow space may have surface portions that are likewise formed by planar surface-area elements. To optimize the reflection and refraction in this region, the hollow space or its surfaces may be formed as a so-called "cat's-eye" to produce back reflections. Such a retroreflection zone may be provided in the head and/or handle.

Further preferred material combinations may also be used if, in addition to a completely transparent material, an additional, possibly opaque hard and/or soft material is to be used in a multi-component injection-molding process.

BRIEF SUMMARY OF THE INVENTION

Particularly preferred embodiments of the toothbrush according to the invention are described in detail below on the basis of a drawing, in which purely schematically:

Figure 39:
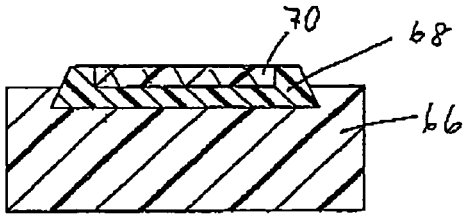

FIG. 39 shows a cross section of a plastic body in which the second hard component (polypropylene PP) (diagonal hatching when viewed in the prescribed manner from bottom right to top left) is mechanically anchored on top of the first hard component (diagonal hatching when viewed in the prescribed manner from bottom left to top right) by means of a dovetail joint; and FIG. 40-FIG. 45 show perspective views of further embodiments of toothbrushes according to the invention, with variously formed control elements or geometrical elements for providing advantageous holding positions for a user.

DETAILED DESCRIPTON OF THE DRAWINGS

Figure 1:
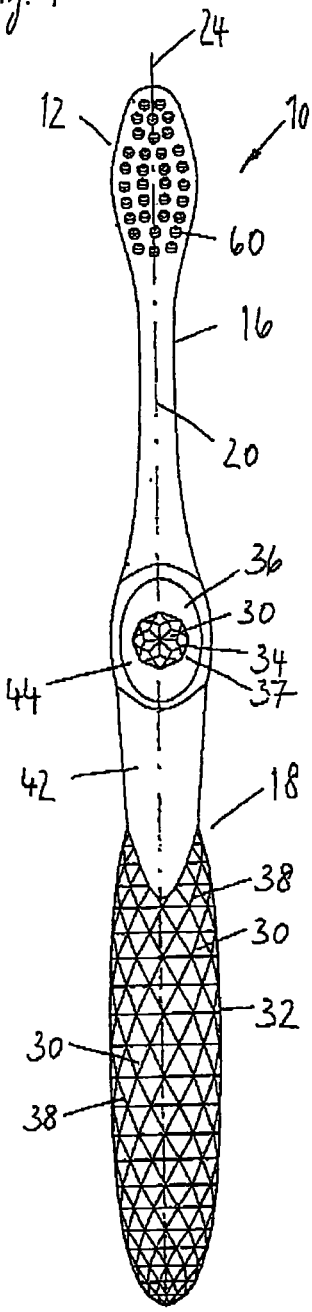
FIG. 1 shows a plan view of a toothbrush according to the invention, which has a handle with a multiplicity of triangular planar surface-area elements.

The toothbrush 10 according to the invention that is shown in FIG. 1 has a head 12, also referred to as a treatment head, which is intended for carrying bristles 14 (not shown in FIG. 1), a neck 16, adjoining the head 12, and an elongate handle 18, arranged on the neck 16 opposite from the head 12. The representation in FIG. 1 shows the upper side 20 of the toothbrush 10 that is intended for carrying bristles 14. An underside 22, opposite from the upper side 20, of the toothbrush 10 shown in FIG. 1 is represented in FIG. 3. In the case of the embodiment shown in FIG. 1 to FIG. 3, the neck 16 and the head 12 have a continuously smooth surface.

Figure 2:
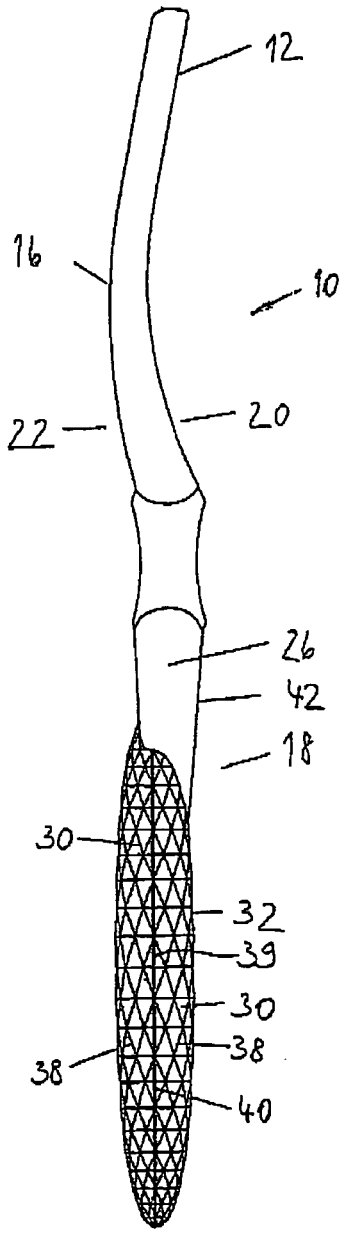
FIG. 2 shows a side view of the toothbrush shown in FIG. 1, a production-induced mold parting line that runs in the longitudinal direction of the handle and forms an edge line being emphasized merely for the purpose of better illustration.
Figure 3:
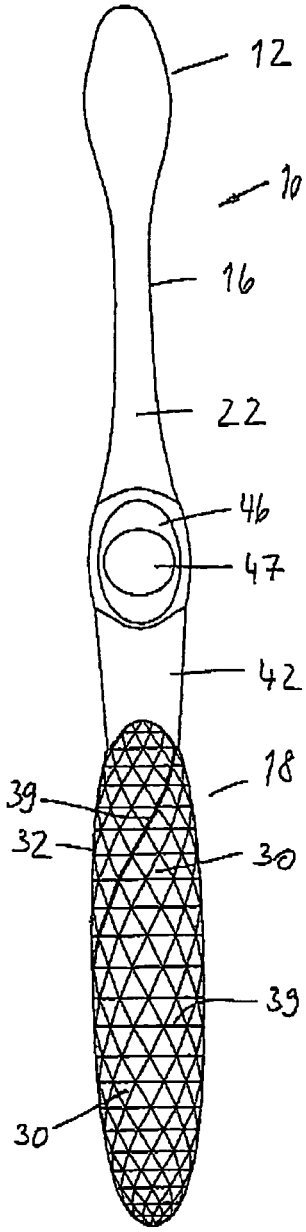
FIG. 3 shows a view from below of the toothbrush shown in FIG. 1 and FIG. 2, here, too, an edge line that runs in the circumferential direction of the handle and wraps spirally around the handle being emphasized merely for the purpose of better illustration.

The toothbrush 10 shown in FIG. 1 to FIG. 3 is preferably formed symmetrically with respect to its longitudinal center plane 24, which runs at right angles to the upper side 20 and the underside 22. The toothbrush 10 is laterally delimited by two, preferably mirror-symmetrical, side faces 26, one of which is represented in the side view of FIG. 2.

Part of the surface of the handle 18 is provided in a facet-like manner with a multiplicity of essentially planar surface-area elements 30. In the case of the embodiment shown, approximately a rear third of the toothbrush 10 that is opposite from the head 12 and is enclosed by the surface of the hand during use is configured in such a way. The at least virtually planar surface-area elements 30 are in this case formed both on the surface of an ellipsoidal handle body 32, which is arranged in the free end region that is enclosed by the inner surface of the hand during use, and on a rosette-like depression 34 of a thumb rest 36 that is formed on the handle 18 on the neck side. This depression 34 can perform the function of a control element 37, by the individual surface-area elements 30 assuming or predetermining a preferred holding position for the user. It goes without saying that a corresponding control element 37 may also be provided at another location of the handle 18 and be formed as an elevation protruding from the handle 18. In addition, surface-area elements 30 are of course also conceivable on the neck 16 or on the head 12 of the toothbrush 10.

The essentially planar surface-area elements 30 have a triangular base area with a maximum extent of 0.2 mm to 8 mm, preferably of 0.5 mm to 6 mm. They are respectively arranged in such a way that they are directly adjacent one another and thereby form element edges 38.

The surface-area elements 30 are advantageously planar, to allow the advantages according to the invention to be achieved. They may, however, also be slightly convexly or concavely curved or bent. The radius of curvature of the surface-area elements 30 is in this case much greater than the radius of curvature of the roundings of the handle approximated by them.

The surface-area elements 30 cover the handle body 32 in a facet-like manner. In this way, they approximately reproduce the essentially rounded basic form of the handle 18. Apart from the ellipsoidal basic form that is shown, different elongate-rounded basic forms may also be approximated by the multiplicity of surface-area elements 30 as shown for example in FIG. 8 and FIG. 13 to FIG. 16.

The planar surface-area elements 30 may alternatively also have n-gonal, in particular rectangular, square, rhombic, pentagonal, hexagonal, circular or elliptical base areas or base areas made up of n-gonal, circular or elliptical base elements, which may, if appropriate, also be provided with reentrant angles. Particularly preferred, however, are triangular base areas, which in the case of the facet-like arrangement shown in FIG. 1 to FIG. 3 form what is known as a Briolette cut and thereby give the basic body 34 a diamond-like appearance. In the case of this specific arrangement, a respective element edge 38 of the surface-area elements 30 is preferably oriented at right angles to the longitudinal axis of the handle 18.

The surface-area elements 30 or the surface structure formed by them is or are preferably embodied in a uniform manner over the entire region configured by them. Many of the triangular surface-area elements 30 have an equilateral or at least isosceles basic form.

Element edges 38 adjoining one another form contiguous edge lines 39, running over the handle 18. Merely for the purpose of illustration, edge lines 39 provided in FIGS. 2 and 3 with the reference numeral 39 are emphasized by a greater line thickness. Edge lines 39 that wrap at least virtually spirally around the handle 18 or run at least virtually in the longitudinal direction of the handle 18 are particularly advantageous.

When the handle 18 is taken in the hand of the user, the element edges 38 and the edge lines 39 form contact lines which improve the way in which liquids that get between the hand and the handle 18 are transported away, and are consequently conducive to secure handling of the toothbrush 10. If appropriate, the edge lines 39 may be formed in such a way that they protrude radially outward with respect to adjacent element edges 38. Moreover, they can be provided with special properties by using special materials, for example a colored soft material. The element edges 38 and surface-area elements 30 may consist of different materials. For example, the element edges 38 may consist of soft material and the surface-area elements 30 consist of hard material.

The surface-area elements 30 together with their element edges 38 and the edge lines 39 thereby formed offer the advantage that the toothbrush 10 can be held well in the hand of a user in different rotational positions thereof with respect to its longitudinal axis, with a basic form of the handle 18 that is at the same time rounded and consequently ergonomically favorable. On the one hand, this avoids pressure points and, on the other hand, the planar surface-area elements 30 and the corresponding element edges 38 provide a multiplicity of resting surfaces and edge lines 39. Slipping off of the hand, and possibly accompanying injuries to the gums, are avoided to a great extent. Given a special arrangement and appropriate size, the surface-area elements 30 may also be combined to form an already previously mentioned control element 37. In this case, the individual surface-area elements 30 of the control element 37 form preferred holding positions, which allow an optimized cleaning performance of the bristle zone. The arrangement may be configured for example as a contour protruding from or recessed into the toothbrush body.

When they rest on the inner surface of the hand, the element edges 38 and edge lines 39 have the effect that smaller hollow spaces form between the inner surface of the hand and the handle 18, conducive to the flowing away of liquids that get into these spaces.

Furthermore, a visual, preferably crystal-like effect that results from the facet-like arrangement of the surface-area elements 30, in particular when a transparent or translucent material is used for the handle 18, may attract the attention of a user, improve the recognizability of a specific toothbrush 10 and make it possible for the end of a period of use of the toothbrush 10 to be identified from the changed visual properties of the handle 18 or the entire toothbrush body, for example on account of scratches or scores.

As can be seen from FIG. 1 to FIG. 3, the surface-area elements 30 are similar to one another, irrespective of their position on the handle 18. That is to say that, although their extents and/or angles enclosed by the element edges 38 change in dependence on the position of the surface-area elements 30 along the longitudinal axis of the handle 18 and/or the circumferential length of the handle at their respective position, the basic form is essentially maintained over preferably the entire handle 18. Correspondingly, given a constant number of surface-area elements 30 around the circumference, the triangular base areas are smaller in the free end region, narrowing in the circumferential length, or end region on the neck side of the handle body 32, than in a middle portion of the handle body 32. It is generally the case that, given a constant number of surface-area elements 30, the size of their base areas is scaled with the configuration of the handle 18. The size of the base areas is in this case adapted so as to obtain with a corresponding number of assigned element edges 38 an "uneven" surface of the handle 18.

Essentially independently of the form and the absolute extent of their base area, it is preferably the case with all the planar surface-area elements 30 that the ratio of their extent in the longitudinal direction of the handle 18 to the extent in the circumferential direction of the handle 18 is less than 5:1.

The circumferential length of the handle 18 varies in dependence on its cross-sectional form and extent. The maximum height of the handle 18 between the upper side 20 and the underside 22 is between 8 mm and 16 mm, preferably 10 mm and 12 mm, the maximum width of the handle 18 at right angles to the longitudinal axis is 12 mm to 21 mm, preferably 15 mm to 18 mm. Generally, the width measures more than the height in the case of this embodiment.

The facet-like arrangement of the surface-area elements 30 for the approximate formation of a voluminous, rounded handle 18 requires a respectively angular arrangement of adjacent surface-area elements 30. The angle enclosed by surface normals of adjacent surface-area elements 30 in a middle handle portion with respect to the longitudinal axis of the handle 18 is between 1° and 30°, preferably between 1° and 15°. In the free end region of the handle 18, these angles are between 20° and 50°, preferably between 30° and 40°. The angles of the surface normals may in this case vary according to the specific position of the surface-area elements 30 on the handle 18 and the handle form that is to be approximated.

In the case of large radii of curvature in the basic form of the handle 18, the angles of the surface normals of adjacent surface-area elements 30 are generally smaller than in the case of smaller radii of curvature of the basic form of the handle. This can be seen for example in FIG. 5, where a large radius of curvature on the upper side 20 and the underside 22 of the toothbrush 10 requires smaller angles between the surface normals than the comparatively small radius of curvature on the side faces 26. In the case of the embodiment shown in FIG. 1 to FIG. 3, the angles in a middle region with respect to the longitudinal axis, measured in the longitudinal center plane of the handle body 32, are approximately 5°, in the free end region of the handle body 32 approximately 33°.

To avoid a possible risk of injury being caused by the element edges 38, the latter are slightly rounded between adjacent surface-area elements 30. Their radius of rounding is less than 0.5 mm, preferably less than 0.1 mm.

The handle 18 may have one or more surface portions with facet-like arrangements of surface-area elements 30. At least one portion that reaches from the free end of the handle 18 over the handle body 32 to before the thumb rest 36 is preferably formed. Alternatively, at least a major part that is held in the surface of the hand by the user during the use of the toothbrush 10 is provided with a facet-like arrangement. In this case it is also possible for only one or more smaller surface portions that are configured as control elements 37 with surface-area elements 30 to be provided. These are preferably located in the handle 18 or at the transition between the handle 18 and the neck 16 or in the region of the thumb rest 36. They allow precise guidance of the toothbrush 10 and predetermine various optimum holding positions by means of the set angle between the surface-area elements 30 and the bristle zone.

The handle body 32 extends over approximately 45% to 65% of the total length of the toothbrush 10, which measures approximately 120 mm to 230 mm, preferably 190 mm to 200 mm, along its longitudinal axis. The longitudinal extent of the portion with the facet-like arrangement of surface-area elements 30 on the bristle-covered upper side 20 of the toothbrush 10, measured from the free end of the handle 18 in the direction of the head 12, is between 50 mm and 80 mm, preferably between 61 mm and 68 mm. On the underside 22, the portion has a length of 70 mm to 90 mm, preferably 77 mm to 83 mm. The lateral length of the portion is between 65 mm and 85 mm, preferably 73 mm and 79 mm.

The free end region of the handle 18 represented in FIGS. 1 to 3 is preferably configured in such a way that the planar surface-area elements 30 reach up to the free end of the handle 18. To reduce the risk of injury, the free end region of the handle 18 is preferably formed as a rounded dome.

The facet-like arrangement of surface-area elements 30 preferably extends around the entire circumference of the handle. However, it is alternatively also possible for merely band-like or smaller area-like portions to be provided with the facet-like arrangement, as shown for example in FIG. 13 to FIG. 15. It is also possible to arrange the surface-area elements 30 in a combination of bands and areas, with it also being possible for a number of bands and/or areas to be combined with one another.

The handle 18, as well as the toothbrush 10 according to the invention itself, is preferably produced in an injection-molding process. The injection molding tools used for this are preferably embodied as two parts and form along their cavity-side contact line on the completed toothbrush 10 a tool parting line 40 running longitudinally around the handle 18 or the toothbrush 10. For easy demolding of the cured toothbrush 10 or the handle 18 after the injection molding, the halves of the injection molding tool are preferably formed in such a way that the planar surface-area elements 30 formed by them do not protrude beyond or interrupt the tool parting line 40. As a consequence of this, element edges 38 therefore run on the tool parting line 40. In order during demolding not to damage or scratch the surface-area elements 30 of which the element edges 38 form the tool parting line 40, these surface-area elements 30 assume a demolding angle of at least 1°, preferably of at least 3°.

To make this possible and at the same time ensure a similarity of planar surface-area elements 30 also along and beyond the tool parting line 40, the surface-area elements 30 adjacent the tool parting line 40 are either made smaller in their base area or correspondingly adapted in their basic form. For this purpose, as can be seen for example in FIG. 2, the triangular, planar surface-area elements 30 may be respectively subdivided along the tool parting line 40 into two smaller, likewise triangular surface-area elements 30. As a result of this, no actual interruption in the facet-like arrangement extending over the upper side 20 and underside 22 of the handle 18 is produced even along the tool parting line 40. However, if the side faces 26 are closely observed, it is still possible to make out the tool parting line 40, which is continuous and represented as a straight line in this embodiment in the representation of FIG. 2. It goes without saying that, in an alternative embodiment, the tool parting line 40 may also follow any desired, three-dimensional path. The adjacent surface-area elements 30 are accordingly adapted. In principle, the tool parting line 40 does not form a "foreign body", but is integrated in the surface portion as an edge line 39 that is formed from the element edges 38.

The toothbrush 10, preferably produced in an injection-molding process, as mentioned above, may be produced from a hard material and/or a soft material and/or a combination of a hard material and a soft material. A hard material is preferably used. Plastics from the group comprising polypropylene (PP), polyester (PET), polyethylene (PE), polystyrene (PS), styrene acrylonitrile (SAN), polyoxyethylene (POM), polymethylmethacrylate (PMMA), acrylonitrile butadiene styrene (ABS), polycyclohexane dimethanol terephthalate (PCT/PCT-A (acid-modified), PCT-G (glycol-modified)), polyamide (PA), etc., preferably SAN, PS or PET, are preferably used as the hard material. Transparent or translucent embodiments of the materials are used with preference for this, in order to bring about special visual effects in conjunction with a specific arrangement of surface-area elements 30. The transparent or translucent materials have in this case a refractive index of 0.4-2.5, preferably of 0.5-2, and a light transmission according to the standard ASTM D1003 of 80% to 98%, preferably of 85% to 95%. The hard material preferably forms a basic structure of the toothbrush 10, onto which the soft materials are molded.

Low-density polyethylene (PE-LD), high-density polyethylene (PE-HD), polyethylene (PE), rubber-elastic materials, such as polyurethane (PUR), thermoplastic elastomers (TPE), polyvinyl chloride (PVC), etc., are used for example as soft materials, preferably a thermoplastic elastomer (TPE). The Shore A hardnesses of the soft materials preferably lie below 90. Soft materials are used in particular to improve the feel, for example in the region of the thumb rest 36 and the handle body 32, for instance in the case of the surface-area elements 30 and/or in the region of the element edges 38. To achieve an optimum feel and to prevent small segments of soft material becoming detached, use is made of the fact that the soft material preferably enters into a bond with the hard material on account of the two-component or multi-component injection-molding process of the soft and hard materials involved. In addition, the soft materials are used in the region of the head 12 for damping mechanical shocks during the use of the toothbrush 10 in the oral cavity or in the case of cleaning massaging elements (see reference numeral 41 in FIG. 32 and FIG. 33). Soft materials may additionally be used in all the regions of the toothbrush 10 for forming decorative or additional feel-related elements.

The surfaces of the surface-area elements 30 may be formed both from hard material and/or from soft material. To achieve an optimum holding effect, preferably at least some of the surface-area elements 30 are of a polished configuration. For this purpose, the corresponding generating surface of the injection molding tool must of course likewise be of a polished configuration.

In order likewise to improve the feel of surfaces that are not provided with surface-area elements 30, they may have an eroded, i.e. not polished, surface structure.

In an embodiment not represented, individual surface-area elements 30 or portions of the surface of the handle with surface-area elements 30 consisting of hard material are surrounded by surface portions of soft material, which preferably form a continuously smooth surface. It goes without saying that the converse case, where surface-area elements 30 of soft material are surrounded by continuously smooth surface portions of hard material, is also possible.

Figure 15:
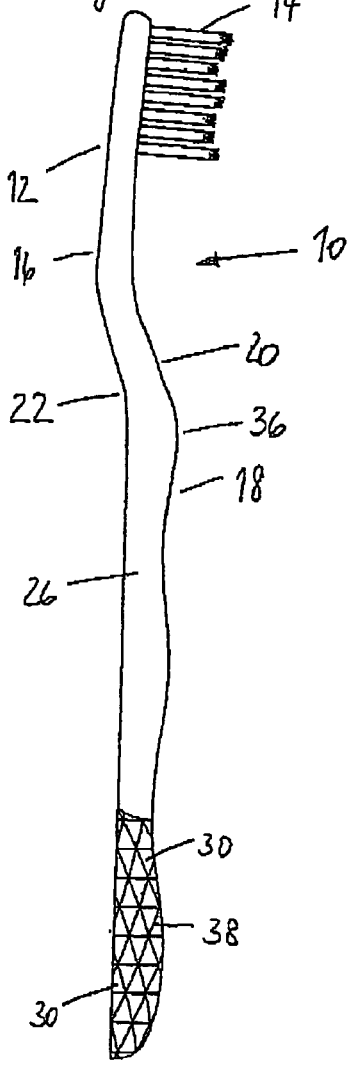
FIG. 15 shows a side view of the toothbrush shown in FIG. 13 and FIG. 14.
Figure 26:
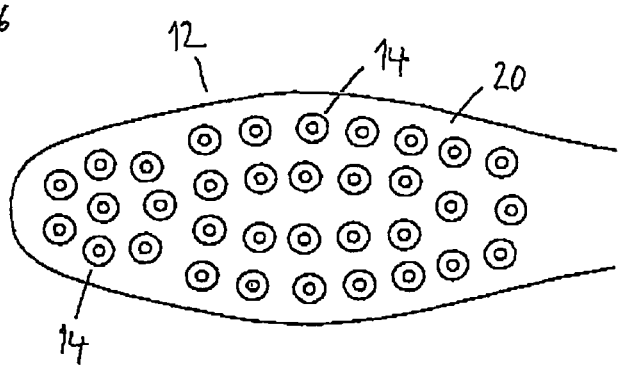
FIG. 26 shows a plan view of a head of a toothbrush according to the invention, with an upper side which is covered with pointed bristles.
Figure 27:
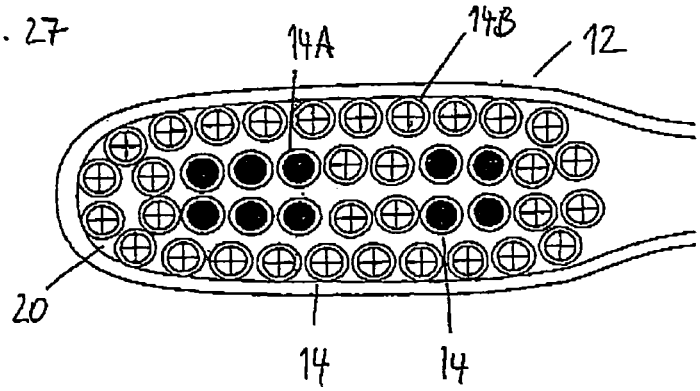
FIG. 27 shows a plan view of a further embodiment of the upper side of a head, in which bristle clusters with cylindrical bristles are surrounded by bristle clusters with pointed bristles.
Figure 28:
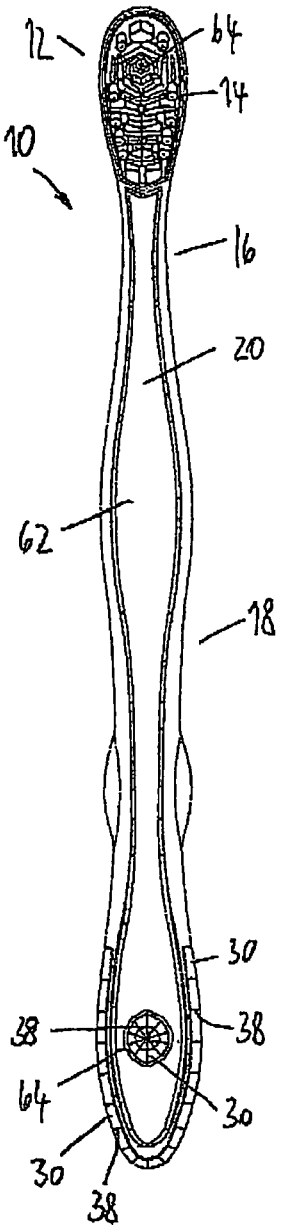
FIG. 28 shows a plan view of a further embodiment of a toothbrush according to the invention, with surface-area elements in a portion at the free end region of the handle.
Figure 29:
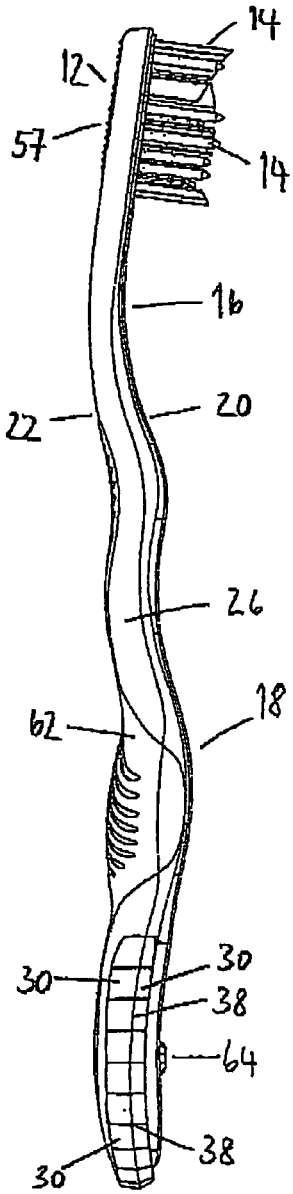
FIG. 29 shows a side view of the toothbrush shown in FIG. 28.
Figure 30:
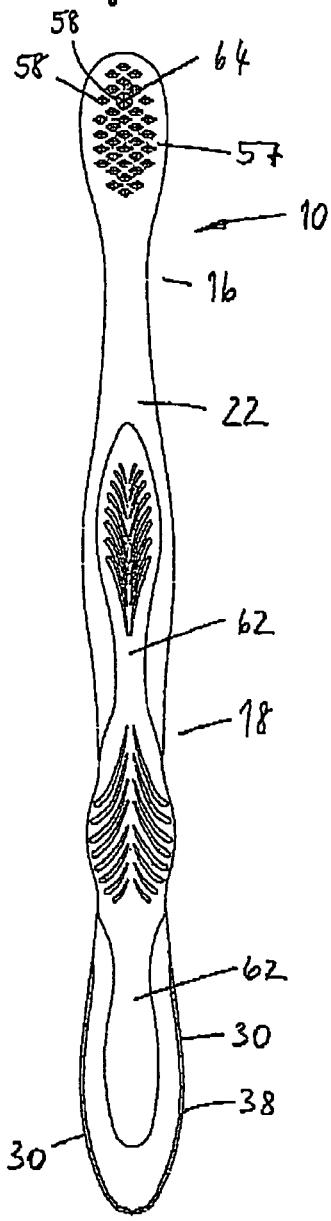
FIG. 30 shows a view from below of the toothbrush shown FIG. 28 and FIG. 29.
Figure 31:
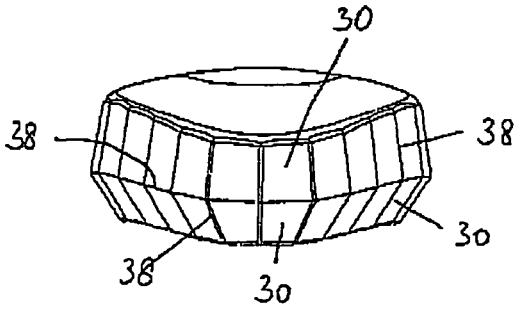
FIG. 31 shows a plan view of the free end region of the handle of the toothbrush represented in FIG. 28 to FIG. 30.

The bristles 14 shown for example in FIGS. 15, 26 and 27 are preferably produced from polyamide (PA) or polyester (PBT). They may be supplemented in the bristle zone by rubber-elastic cleaning or massaging elements 41 (see FIG. 32 FIG. 33) of one of the aforementioned soft materials. The bristles 14 preferably have a round cross section, which in the case of cylindrical bristles 14A is at least virtually constant over their entire length, or they may be formed as pointed bristles 14B with a cross section decreasing toward their free end. In this case, the diameter of the pointed bristles 14B decreases essentially linearly essentially over the free 8 mm up to the end of the bristles.

For an improved feel and appearance of the toothbrush 10, individual surface-area elements 30 or element edges 38 may be provided with different surface roughnesses. For this purpose, the relevant wall portions in the injection molding tool are, for example, highly polished, eroded, roughened or sandblasted, so that they have a roughness value of virtually 0 or are provided with a surface roughness of between Rz=6.3 and 25.

Furthermore, it is possible to electrocoat the entire toothbrush 10, or preferably only surface portions or individual surface-area elements 30, element edges 38 or edge lines 39 of the toothbrush 10, with a metal, for example nickel, chromium, silver or gold. It goes without saying that other processes may also be used for the metallic coating, such as for example stamping by means of a metallic transfer foil, sputtering, plasma coating, hot stamping or decal processes. If light reflections are intended on the surfaces, the metallically coated surface is preferably provided on a continuous, smooth surface portion on the opposite side of the handle from a surface portion provided with surface-area elements 30. The region of the improvement or changing of the surface roughness has symmetrically with respect to the edge in the region of the element edges 38 a width of respectively between 0.05 mm and 1 mm, preferably 0.1 mm and 0.5 mm. The coating serves for protecting the plastic surfaces from scratching or wear and also decorative effects. It is likewise possible within a surface portion having surface-area elements 30 to cover some surface-area elements 30 of hard material with soft materials, for example to form protruding nubs or generally to improve the feel or the appearance, in order in this way to give the feeling of a better grip. It is similarly possible to replace individual surface-area elements 30 with concave recesses or convex protuberances.

As shown in FIG. 1 to FIG. 3, a narrowed front handle part 42, with a continuously smooth surface, is formed between the handle body 32 and the thumb rest 36. The transition between the front handle part 42 and the handle body 32 may take place discontinuously, as shown in the figures, or else alternatively continuously. The surface of the front handle part 42 may also be provided with planar surface-area elements 30, so that the facet-like surface of the handle reaches up to directly before the thumb rest 36. It is similarly possible to extend the facet-like arrangement of the surface-area elements 30 to such an extent that it also encloses the thumb resting area 44.

As already mentioned above, the thumb rest 36 has on the upper side 20 of the toothbrush 10 a rosette-like depression 34. The planar surface-area elements 30 formed in the rosette-like depression 24 may be formed identically, similarly or differently to or from the surface-area elements 30 of the handle body 32. The rosette-like depression 34 is surrounded by an elliptical, continuously smooth thumb resting area 44.

The length of the principal axis of the elliptical thumb resting area 44, projected onto the upper side 20, is between 16 mm and 23 mm, preferably between 18 mm and 21 mm. The length of the secondary axis, projected onto the upper side 20, is between 8 mm and 15 mm, preferably between 10.5 mm and 13.5 mm. It goes without saying that the depression 34 may also be chosen to be larger, in particular it would be advisable in the sense of a control element 37 to choose the depression 34 to be of a size such that the thumb of the user can be introduced at least partially into the depression 34. For this purpose, the depression 34 may also have an oval basic form, set with surface-area elements 30.

Formed on the underside 22, as shown in FIG. 3, opposite from the thumb rest 36 on the upper side 20, is a preferably planar decorative area 46, which preferably has the same dimensions as the thumb resting area 44. The decorative area 46 is preferably at least partially provided with an area-like decorative element 47, for example a color foil, image foil, metal foil, a representation by means of pad printing or screen printing, a label, an adhesive image, etc. The decorative element 47 may be formed, for example, by a gold or silver coating or a hard and/or soft material of a different color, which is molded on during the injection molding. Spatially extending decorative elements 47, such as thicker metal foils, metal pieces or metal rings are likewise conceivable, and are then partially or completely integrated in the handle 18, i.e. fitted in a recess, in order to make it possible for the decorative area 46 to run in a planar manner on the underside 22. The recess has in this case a depth of 0.1 mm to 1 mm, preferably of 0.3 mm to 0.7 mm.

The planar decorative area 46 on the underside 22 of the toothbrush 10 is preferably provided with an area-like circular or oval colored element. The circular element has a diameter of 7 mm to 12.5 mm, but preferably of 8.5 mm to 11 mm. Furthermore, it is possible to use similar forms for the decorative element 47 as for the surface-area elements 30 on the handle 18 or in the rosette-like depression 34.

In the region around the rosette-like depression 24 and/or the thumb resting area 44, an annular decoration may be applied, on the upper side 20 and on the underside 22 if a depression is formed on both sides, forming a ring around the depression or the depressions. The width of this ring, measured radially, is between 0.1 mm and 2 mm, preferably 0.1 mm and 1.5 mm.

Parts of the elliptical thumb resting area 44, of the rosette-like depression 34 or the decorative area 46, or else individual surface-area elements 30, may be provided on the one hand with a particularly low surface roughness or with a higher, previously specified roughness. For this purpose, the injection molding tools are highly polished at the corresponding locations and have a roughness value near to 0, or they are provided with a surface roughness of between Rz=6.3 and 25.

In the region of the thumb resting area 44 and the decorative area 46 there is preferably a larger area with higher roughness running in a ring around the longitudinal axis of the handle 18. With reference to the tool parting line 40, this region measures between 11 mm and 22 mm, preferably 14 mm and 19 mm, while the thumb resting area 44 and the decorative area 46 are surrounded by this region over a width of 0.3 mm to 3 mm, preferably 0.4 mm to 2.5 mm.

Apart from a continuously planar configuration of the underside 22 in the region of the thumb rest 36, it is likewise possible to form a depression on the underside similar to the depression 34. In this case, on both sides there is in the region of the thumb recess 36 a preferably similar depression 34, arranged symmetrically in relation to each other, whereby the distance between their respective deepest points is minimized.

Furthermore, it is possible to provide the handle 18 with a stamping or inscription area. The stamping or inscription area is preferably provided on the continuously smooth surface on the underside 22 or the upper side 20 of the front handle part 42. The stamping or inscription may take place by means of stamping, image foil stamping or printing (pad printing or screen printing). Preferably, a silver foil is applied by means of the stamping. Furthermore, it is possible to apply gold or other metal foils, color foils, image foils or a label. The stamping or inscription may, for example, also be integrated in the surface of the handle 18 as a positively or negatively configured form. A positive configuration of the form requires a zone that is recessed from the surface and from which the form protrudes. A negative form is depressed according to its form. The depth of the zone or of the lettering is between 0.1 mm and 1 mm, preferably between 0.2 mm and 0.5 mm. In both cases, the forming of the lettering is already realized in the injection molding tool, which does not require any additional machining steps.

One or more, preferably one, larger, continuously smooth, planar sub-area or sub-areas may be configured on the handle 18 between the surface-area elements 30 to allow the stamping or inscription to be realized. If application of the inscription by means of the above processes is not possible, active elements may also be adhesively attached. For this purpose, one or more island-like surface portions (also islands for short) may be provided with a continuously smooth surface in a surface portion that is provided with surface-area elements 30.

The length of the stamping area in the direction of the longitudinal axis of the handle 18 is 17 mm to 25 mm, preferably 19 mm to 23 mm. The width, at right angles to the length, is 1.5 mm to 7 mm, preferably 3 mm to 5 mm. The side of the stamping area that is facing the free end of the handle 18 is at a distance from the free end of 55 mm to 85 mm, preferably 65 mm to 75 mm.

If transparent or translucent materials are used for the handle 18, the stamping or the inscription is at least approximately visible through the handle 18. Specific arrangements of surface-area elements 30 may cause an apparent distortion, enlargement or reduction of the stamping or inscription for a viewer as a result of optical reflections and refractions. With particular preference, an optical multiplication of the inscriptions or other visual elements may be caused by the reflections.

Figure 4:
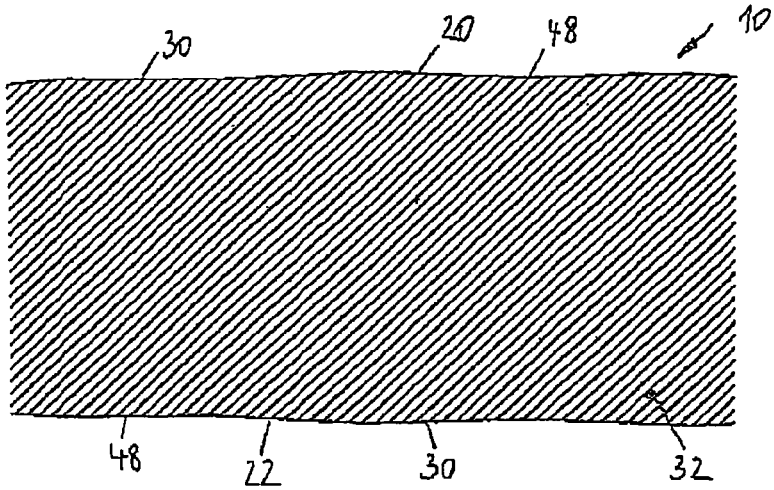
FIG. 4 shows a detail of a longitudinal section through the handle of the toothbrush shown in FIG. 1 to FIG. 3, with a concave-convex profile of the outer sectional lines.

As shown in FIG. 4, sectional lines 48 of a longitudinal section through the handle 18 provided with planar surface-area elements 30 have a concave-convex profile, at least in certain portions. In the case of the representation in FIG. 4, the longitudinal axis of the handle 18 lies in the chosen longitudinal sectional plane. Depending on the extent of the facet-like arrangement of surface-area elements 30 and depending on the approximate form of the handle 18, the concave-convex profile is repeated periodically.

Figure 5:
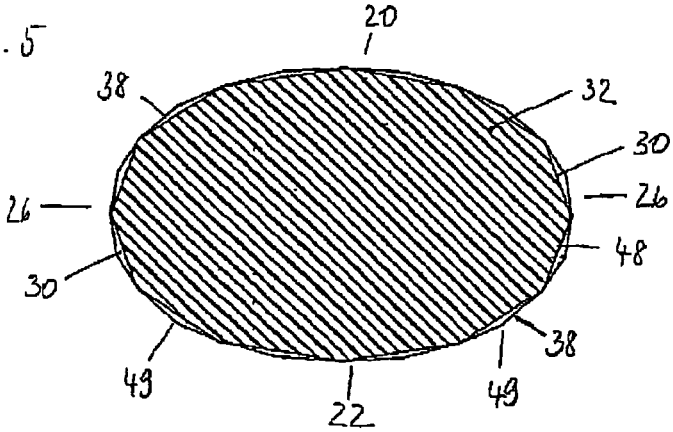
FIG. 5 shows a cross section through the handle of the toothbrush shown in FIG. 1 to FIG. 4 along element edges which are formed by surface-area elements directly adjacent one another.

FIG. 5 shows a cross section through the handle body 32 of the toothbrush 10 shown in FIG. 1 to FIG. 4. The cross section has an rounded-elliptical basic form, which is approximated by the straight sectional lines 48 of twelve planar surface-area elements 30. In the viewing direction of FIG. 5, further element edges 38 can be seen respectively radially outward from the sectional lines 48. Since, in the case of the embodiment shown, the surface-area elements 30 have base areas of an isosceles triangle, the element edges 38 lying behind the sectional plane in the viewing direction respectively form triangle tips 49, which can be seen centrally with respect to the sectionally illustrated surface-area elements 30.

In an embodiment not represented, the handle 18 may additionally also be provided with a hollow space, which is formed during production, for example by means of a mold core or a cover element. In this case, the surface lying in the hollow space may likewise be at least partially provided with—in this case inner—surface-area elements 30.

Figure 6:
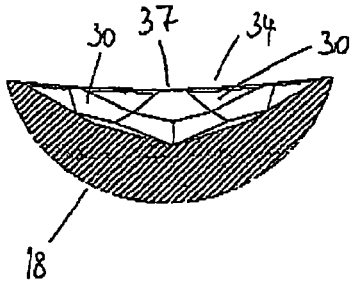
FIG. 6 shows a cross section through the toothbrush shown in FIG. 1 to FIG. 5 at the position of a thumb rest, which is provided with a rosette-like depression.
Figure 7:
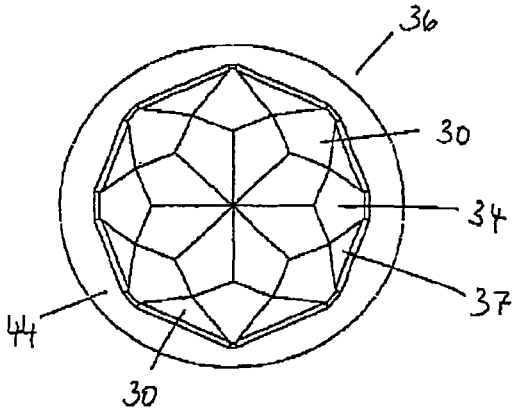
FIG. 7 shows a plan view of the rosette-like depression sectionally illustrated in FIG. 6 and exposed here.

FIG. 6 shows a further cross section through the toothbrush 10 according to the invention that is shown in FIG. 1 to FIG. 5. The sectional plane in this case runs through the center of the rosette-like depression 34 of the thumb rest 36, perpendicularly to the longitudinal axis of the handle 18. The rosette-like depression 34 is represented in FIG. 7 as an enlarged detail. The part of the handle 18 that is filled with material is represented in a hatched manner. On the upper side 20, the depression 34 forms a comfortable rest for the thumb of the user, and can consequently be used as a control element 37. The surface of the rosette-like depression 34 is likewise formed by surface-area elements 30. The position of the depression 34 on the handle 18 makes it obvious to the user to grip the toothbrush 10 in a particularly advantageous way and guide it optimally in terms of the cleaning technique. Alternatively, the rosette-like depression 34 may also be provided with different concave and/or convex surface elements.

The rosette-like depression 34 is arranged on the toothbrush 10 in such a way that it is between 50 mm and 140 mm, preferably 95 mm and 115 mm, away from the free end of the toothbrush 10. The remaining material thickness of the handle 18 between the lowest point of the rosette-like depression 34 and the opposite underside 22 is 4 mm to 8 mm, preferably 5.5 mm to 7 mm.

Figure 8:
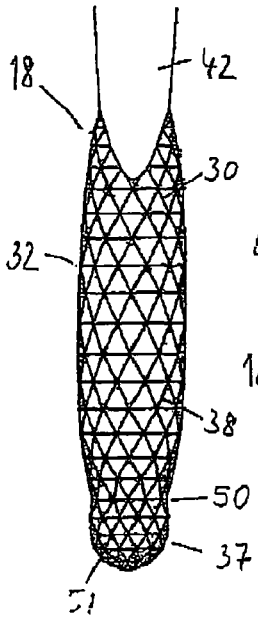
FIG. 8 shows a plan view of a further embodiment of a handle of a toothbrush according to the invention, with a handle narrowing near the free end of the handle.
Figure 40:
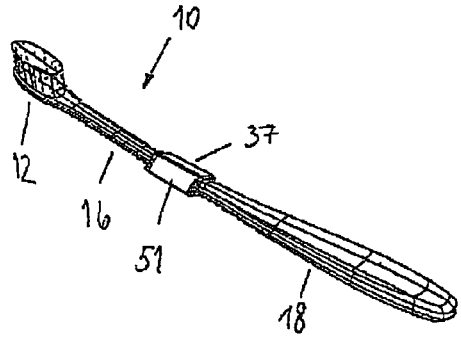
Figure 41:
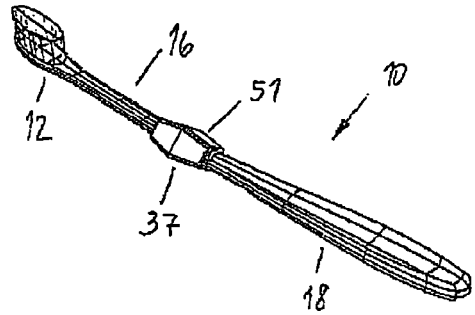
Figure 42:
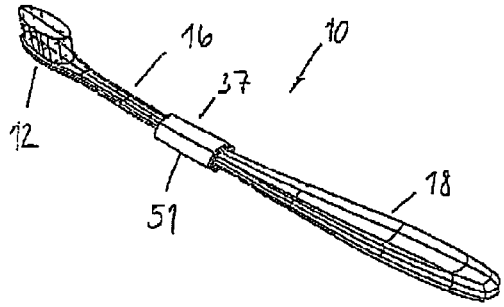
Figure 43:
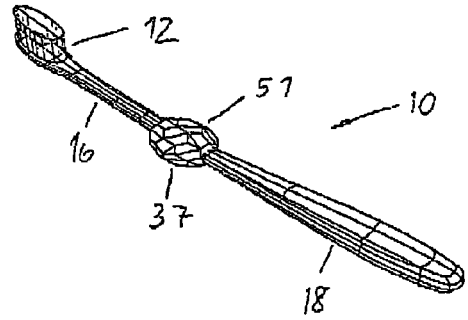
Figure 44:
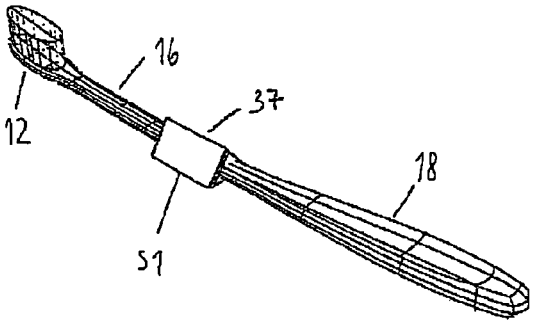
Figure 45:
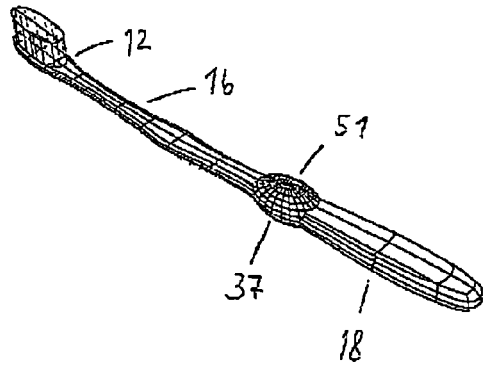

A geometrical element 51, as shown in FIGS. 8, 40 and 45, for example protruding radially from the actual handle 18 and covered with surface-area elements 30, may also be used instead of the rosette-like depression 34. This geometrical element 51 may at least approximately take the form, for example, of a sphere or an ellipsoid (FIGS. 8, 43 and 45), a cone, a prism (with a triangular cross section, see FIG. 44, with a rectangular cross section, see FIGS. 40 and 41, with a pentagonal cross section, see FIG. 42) or a cylinder. This geometrical element 51 serves in turn as a control element 37, to determine optimum holding positions for the user. In this alternative configurational variant, this geometrical element 52 serving as a control element 37 may be positioned not only in the front half of the handle or at the transition from the handle 18 to the neck 16 but also in the rear half of the handle or directly at the free end of the handle (see FIGS. 8 and 40 to 45).

Represented in FIG. 7 is a plan view of the rosette-like depression 34, exposed here. The planar surface-area elements 30 of the rosette-like depression 34 have triangular, rectangular and pentagonal base areas, which have a certain similarity to the planar surface-area elements 30 of the associated handle body 32 that is shown in FIG. 1 to FIG. 3. Consequently, preferably similar base areas, in particular triangular areas, are formed in various regions of the handle 18. In this way, the viewer is given the impression of an overall diamond-like configuration. Apart from the basic forms of the planar surface-area elements 30 described, it is also possible to use n-gonal, circular or elliptical basic forms or basic forms made up of n-gonal, circular or elliptical base areas for the depression 34.

Induced by the angular arrangement of the surface-area elements 30 in the rosette-like depression 34, particular visual effects are achieved when transparent or translucent handle materials are used, and in particular the decorative area 46 provided on or near the underside 22 appears to a viewer to be visually changed. As an alternative to a rosette-like formation of the depression 34, it is of course also possible for other kinds of surface-area elements 30 to be formed, both planar or else concavely or convexly formed and provided with a rough or highly polished or coated surface. Instead of a rosette-like depression, the surface-area elements 30 may also be formed as a radially protruding elevation.

A further embodiment of a handle body 32 is shown in FIG. 8. In this case, the handle body 32 is provided near its free end region with a peripheral narrowing 50 of the handle body, which gives the free end region of the handle body 32 a virtually spherical configuration. As already mentioned above, this geometrical element 51, formed in this way, can be used as a control element 37. Alternatively, other simple or composite, but preferably rounded basic forms, such as for example a cone, cylinder, sphere, prism, ellipsoid, etc., may of course also be approximated by the surface-area elements 30. This makes it possible to form various concave and/or convex regions in the handle 18 along its longitudinal axis. Concave and/or convex regions may, for example, be arranged in isolation at specific positions or peripherally around the longitudinal axis of the handle 18. These geometrical elements 51 that are set apart from the basic form of the toothbrush are used with preference as control elements 37. By means of the surface-area elements 30 that are applied to these set-apart geometrical elements 51, preferred holding positions are predetermined for the user. It goes without saying that larger surface-area elements 30 are used in this case, allowing the fingers to be comfortably set down. These surface-area elements 30 may have a size of up to 150 $mm^2$. It goes without saying that these set-apart geometrical elements 51 may also be used in the sense of a control element 37 without surface-area elements 30 with essentially continuously smooth surfaces. However, this configurational variant is less preferred, since optimum holding positions cannot be predetermined for the user.

Further embodiments of control elements 37 or of geometrical elements 51 are represented by way of example in FIGS. 40-45. In the case of the embodiments shown in FIGS. 43 and 45 they are essentially elliptically formed and in the case of the configurational variants shown in FIGS. 38 to 40 and 42 they are essentially prismatically formed (with a triangular cross section, see FIG. 44, with a rectangular cross section, see FIGS. 40 and 41, with a pentagonal cross section, see FIG. 42). The edges of the control elements 37 or geometrical elements 51 may be stepped or rounded and the cross section of the control elements 37 or geometrical elements 51 may increase or decrease in size along their longitudinal axis (see FIG. 39). The position of the geometrical element 51 on the toothbrush body is similarly given by way of example; it may be positioned not only in the front half of the handle or at the transition from the handle 18 to the neck 16, but also in the rear half of the handle or directly at the free end of the handle. The control element 37 may also be used in the case of other embodiments of toothbrushes.

Figure 9:
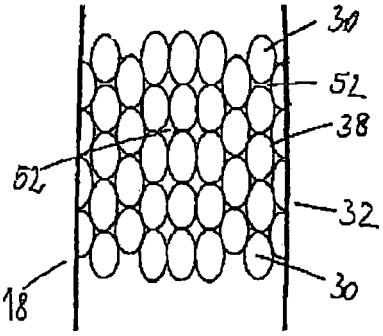
FIG. 9 shows a detail of a plan view of a further embodiment of a handle, in which surface-area elements have an elliptical basic form and are arranged both in rows next to one another and offset with respect to one another.
Figure 10:
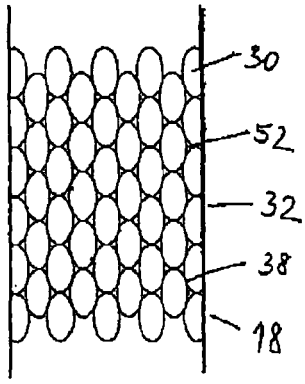
FIG. 10 shows a detail of a plan view of a further embodiment of a handle with elliptical surface-area elements, in which the surface-area elements are exclusively arranged offset with respect to one another.

As already mentioned, the planar surface-area elements 30 may also have elliptical or other rounded base areas. These may, for example, also be asymmetrically rounded base areas. Two such embodiments are shown in the form of details in FIG. 9 and FIG. 10. In the case of the embodiment according to FIG. 9, in a central longitudinal portion the center points of adjacent elliptical surface-area elements 30 are respectively arranged in rows at right angles to the longitudinal axis of the handle 18. They thereby form a group of three times five elliptical surface-area elements 30 that are not offset with respect to one another. This offset-free group is surrounded by elliptical surface-area elements 30 that are, by contrast, arranged offset with respect to one another. In the case of the embodiment in FIG. 10, all the elliptical surface-area elements 30 are arranged offset with respect to one another. Alternatively, the surface-area elements 30 may also all be arranged without offset on the handle 18.

Unlike in the case of surface-filling facets and arrangements of surface-area elements 30 with an n-gonal base area, as for example in the case of the embodiments shown in FIG. 1 to FIG. 3 and in FIG. 8, in which a single basic form or surface-area elements 30 similar to it are respectively used, in the case where rounded, for example elliptical, base areas are used not only the dominant, convexly formed surface-area elements 30 are formed but also what are known as subordinate complementary surface-area elements 52. These complementary surface-area elements 52 fill the space between adjacent identical or similar convex surface-area elements 30 and generally have concave base areas. Apart from planar base areas, the base areas of the complementary surface-area elements 52 may alternatively also be spatially curved. In principle, various combinations of more than one type of surface-area elements 30 and complementary surface-area elements 52 are conceivable. Surface-area elements 30 of the same type are preferably repeated with a certain symmetry.

Figure 11:
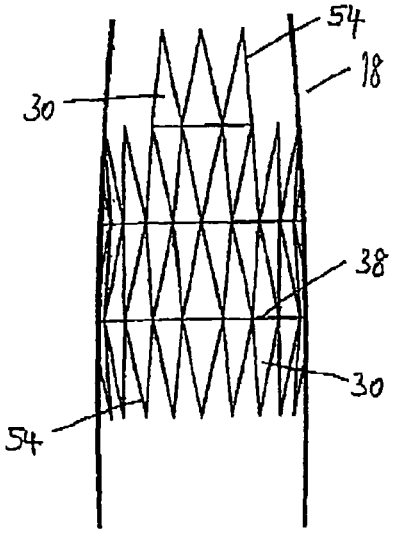
FIG. 11 shows a detail of a plan view of a further embodiment of a toothbrush with a handle, in which a portion of the surface is formed by triangular surface-area elements and this portion is delimited by an open transition with a discontinuous transitional line with respect to the respectively adjacent portions of the handle.
Figure 12:
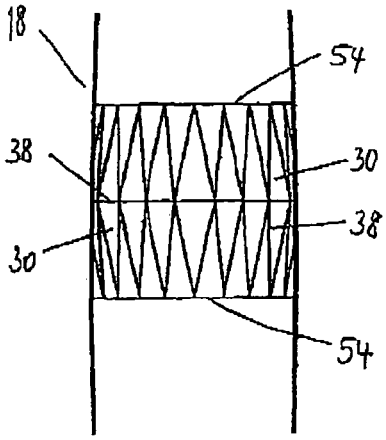
FIG. 12 shows a detail of a plan view of a further embodiment of a toothbrush with a handle, in which a portion of the surface is likewise formed by triangular surface-area elements, but this portion is delimited by a closed transition with a continuous transitional line, in particular running straight around the periphery, with respect to the respectively adjacent portions of the handle.
Figure 13:
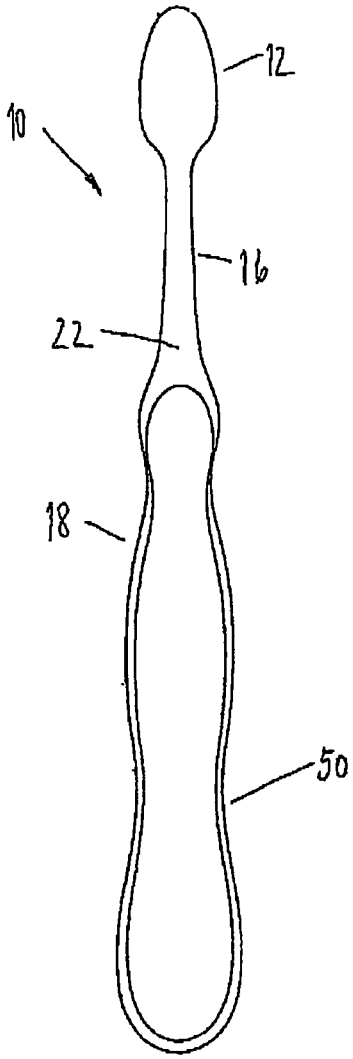
FIG. 13 shows a view from below of a further embodiment of the toothbrush according to the invention, with a flattened handle underside.
Figure 14:
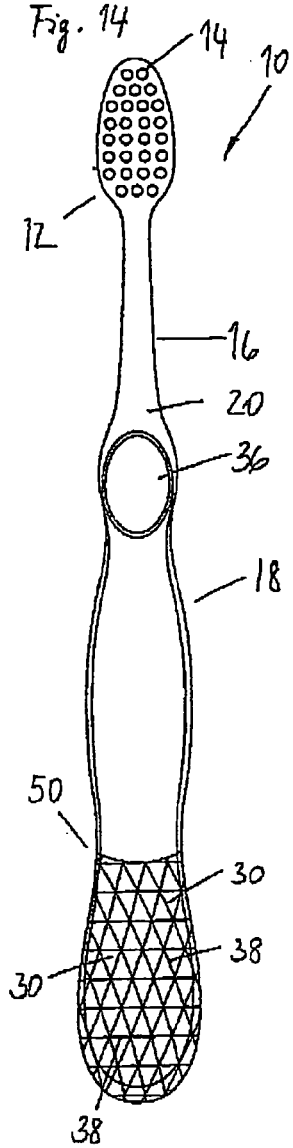
FIG. 14 shows a plan view of the toothbrush shown in FIG. 13.

The facet-like arrangements of planar surface-area elements 30 may extend over different portions of the toothbrush 10 or of the handle 18 and thereby form what are known as open transistors 53A, as shown in FIG. 11, or closed transitions 53B, as shown in FIG. 12, with respect to the surrounding surface configuration. In the case of a closed transition 53B, the facet-like arrangements of the surface-area elements 30 are delimited by a continuous circumferential line 54, preferably running in a straight line around the periphery. On the other hand, in the case of an open transition 53A, the circumferential lines 54 are formed as discontinuous, for example jagged, delimitations of a surface portion, individual surface-area elements 30 or groups of surface-area elements 30 reaching into the differently formed surface portions.

Figure 17:
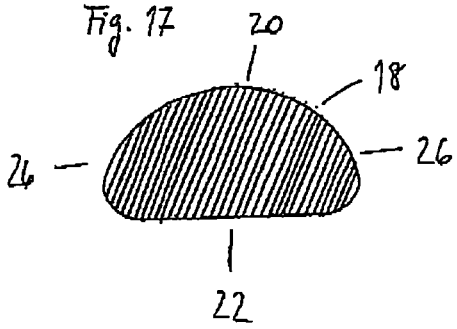
FIG. 17 shows a cross section through a further embodiment of a handle with a halfmoon-shaped cross-sectional area.
Figure 16:
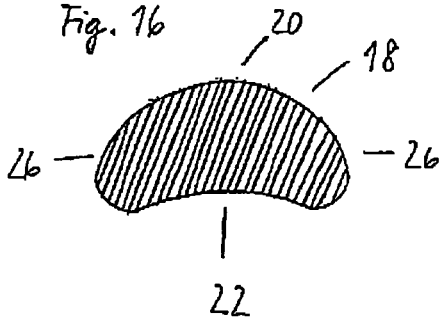
FIG. 16 shows a cross section through the handle of the toothbrush shown in FIG. 13 to FIG. 15, with a kidney-shaped cross-sectional area.

Apart from ellipsoidally rounded basic forms of handles 18 or handle bodies 32, further basic forms, such as for example those shown in FIG. 13 to FIG. 17, are possible. In particular, the underside 22 of the toothbrush 10 according to the invention may in this case be flattened. Cross sections through handles 18 flattened in this way are shown in FIG. 16 and FIG. 17. A cross-sectional area rounded in a kidney-shaped manner is obtained as a section diagram for the toothbrush 10 shown in FIG. 13 to FIG. 15. Cross-sectional areas rounded in a halfmoon-shaped manner, as shown in FIG. 17, are likewise possible.

In both cases, the underside 22, preferably not provided with planar surface-area elements 30, may be used for providing decorative elements and/or stampings or inscriptions or printing. If a transparent or translucent material is used for the handle 18, visual distortions, multiplications, reductions or enlargements of the decorative elements and/or stampings or inscriptions are brought about for the viewer on account of the surface that is convexly curved on the upper side 20 and concavely curved or substantially planar on the underside 22. The enlarging effect caused by the special cross section may also be used in handle regions without surface-area elements 30.

As already mentioned, decorative elements 47 of the toothbrush 10 may be formed in both an area-like manner and a voluminous, protruding manner. The decorative elements 47 are, as already mentioned, set with surface-area elements 30 in the sense of the invention. Examples of voluminous, protruding decorative elements 47 that are arranged in the region of the handle 18 or the neck 16 and once again take basic forms of surface-area elements 30 of the handle 18 are shown in FIG. 18 to FIG. 23. In particular, triangular or crystal-like/hexagonal basic forms are used for this.

Figure 23:
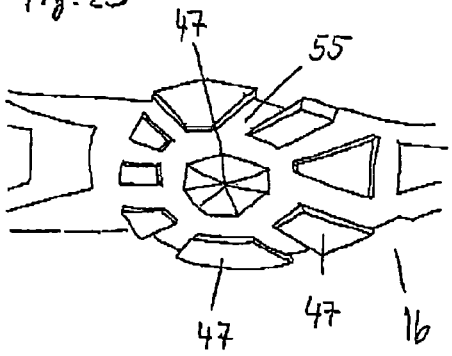

The decorative elements 47 may be curved out or recessed or depressed. They may, moreover, be arranged symmetrically with respect to a longitudinal center plane 24, as shown in FIG. 18 to FIG. 22, or asymmetrically with respect to the longitudinal center plane 24, as shown in FIG. 23. In particular, elastic properties of the toothbrush 10 can be influenced by recess-like decorative elements 47, as shown for example in FIG. 18 or 21, or by protruding decorative elements 47, as shown for example in FIG. 20 or FIG. 23.

Figure 18:
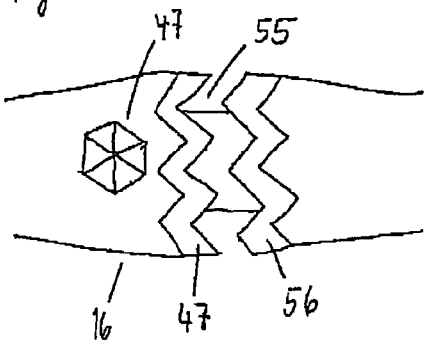
FIG. 18-FIG. 23 show details of plan views of further embodiments of toothbrushes with crystal-shaped decorative elements of a hard and/or soft material.
Figure 19:
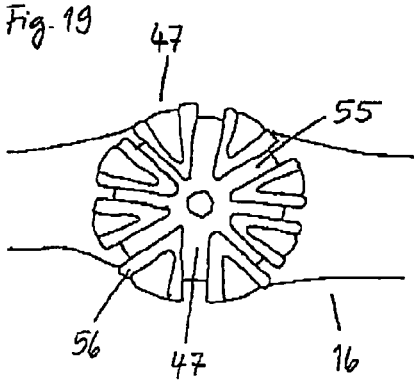
Figure 20:
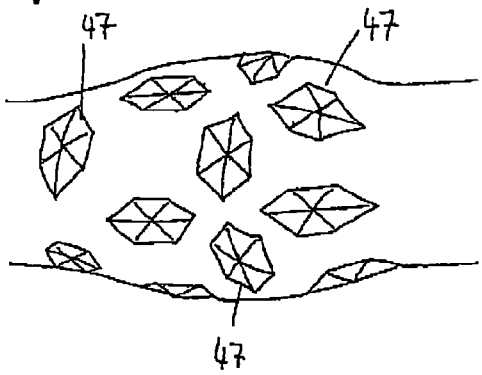
Figure 21:
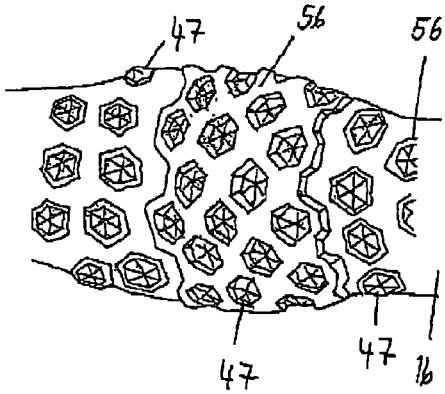
Figure 22:
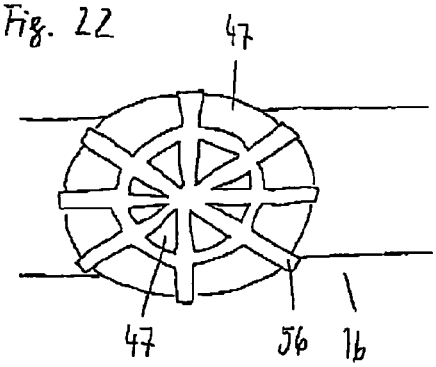

Protruding decorative elements 47 may serve for better resting of the user's hand on the handle 18. In the case of curved-out or depressed decorative elements 47, the surface is additionally structured, and consequently the risk of individual fingers or the hand of the user slipping off the toothbrush 10 is reduced. In particular, as shown in FIG. 18, FIG. 19 and FIG. 23, the decorative elements 47 may form channels 55, to conduct away liquids between the toothbrush 10 and the fingers or the hand of the user, and thereby likewise reduce the risk of slipping off. The decorative elements 47 have identical or similar forms to the surface-area elements 30 that are already arranged on the handle 18. They represent additional points of reference for the guiding of the toothbrush 10. The decorative elements 47 are preferably placed in the middle third and/or in the front third on the neck side of the toothbrush 10.

The decorative elements 47 are formed from a hard and/or a soft material or a combination of hard and soft materials. In FIGS. 18, 19, 31 and 22, decorative elements 47 that can, for example, be formed from soft materials are provided with the reference numeral "56". It is likewise possible to embed individual voluminous, protruding decorative elements 47 of hard material in the surface of continuously smooth soft material.

Figure 24:
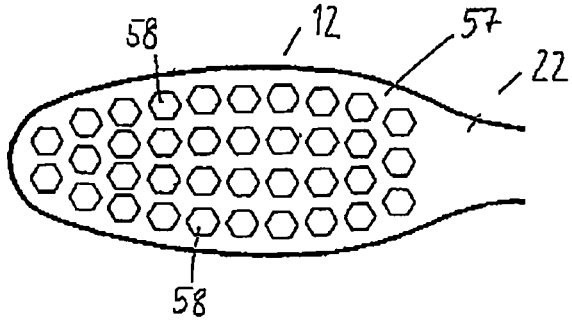
FIG. 24 shows a view from below of a head of a toothbrush according to the invention, with a tongue cleaner which has tongue cleaning elements with a hexagonal base area.
Figure 25:
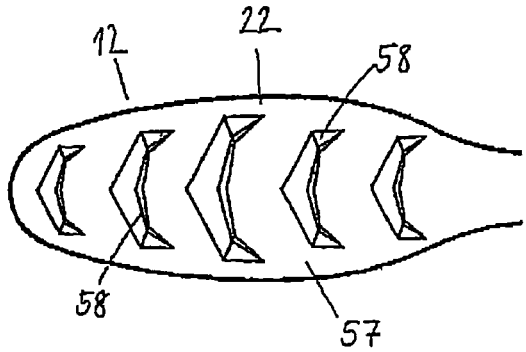
FIG. 25 shows a view from below of a further embodiment of the underside of a head, with a tongue cleaner which has rib-like tongue cleaning elements.

The toothbrush 10 according to the invention is optionally provide on the underside 22 of the head 12 with a tongue cleaner 57. A scraping movement of the tongue cleaner 57 resting on the tongue to be cleaned has the result that the interaction between edges of the tongue cleaner 57 and the tongue to be cleaned brings about a cleaning effect. The tongue cleaner 57 may, for example, be provided with a rough surface structure or with protruding or recessed tongue cleaning elements 58, as shown in FIGS. 24 and 25. The tongue cleaner 57 is formed from hard or soft material or a combination of hard and soft material. Within a region of the tongue cleaner, the various tongue cleaning agents 58 may be formed analogously to the decorative elements 47 or the elements 56 from different materials/material combinations. The tongue cleaning elements 58 likewise at least partially comprise surface-area elements 30.

The tongue cleaning elements 58 shown in FIG. 24 are elevations with a hexagonal base area, which are arranged regularly on the underside 22 of the head 12. The protruding height of the tongue cleaning elements 58 is 0.1 mm to 0.5 mm, preferably 0.2 mm to 0.4 mm. The height of the tongue cleaning elements 58 may be the same on one toothbrush 10 or vary between individual tongue cleaning elements 58. It is likewise possible to use different base areas, such as for example regular and irregular n-gons, circles or ovals for the tongue cleaning elements 58 and/or to arrange the tongue cleaning elements 58 in irregularly on the underside 22 of the head 12. The base areas of the tongue cleaning elements 58 are preferably similar to the base areas of the surface-area elements 30 formed on the handle 18, it being possible for their size to vary from one to the other. The tongue cleaning elements 58 are preferably arranged in the manner of a band or strip, i.e. as a portion of the surface in strip form or in an area-like manner. A combination of a number of such bands and/or strips and/or areas is likewise possible.

Of course, the decorative elements 47 or elements 56 that are shown in FIGS. 18-23 may also be arranged on the underside 22 of the head 12. In this way, the user is already given an appropriate feeling of what to expect when cleaning the tongue when he touches the handle 12 with his hand.

In the case of the embodiment shown in FIG. 25, the tongue cleaning elements 58 are arranged in a rib-like manner at virtually equal intervals transversely to the longitudinal direction of the head 12 on the underside 22. They have a virtually C-shaped base area, which is made up of n-gonal elements. The C-shaped base area is open in the direction of the neck 16. The three end regions, protruding from the head 12, of the tooth cleaning elements 58 form edges, which—as already mentioned—bring about the tongue cleaning. Individual rib-like tongue cleaning elements 58 are similar in their form to one another, but differ in their size. The C-shaped base area may also be formed in a rounded manner, the tongue cleaning element 58 in this case likewise being able to have a round end edge/scraper edge. Tongue cleaning elements 58 may be combined as desired with the decorative elements 47 or the elements 56 from FIGS. 18 to 23 and the tongue cleaning elements 58 from FIG. 24.

In FIG. 26 and FIG. 27, two embodiments of the upper side 20 of the head 12 are represented. The bristles 14 shown there are preferably cylindrical and/or pointed at one end and/or pointed at both ends. As already mentioned, they may be combined in a bristle zone with cleaning or massaging elements 41. For receiving the bristles 14, the head 12 is provided with bristle holes 60. The bristle holes 60 have a diameter of 1 mm to 2 mm, preferably of 1.4 mm to 1.8 mm and have a depth of 2.5 mm to 4.5 mm, preferably of 3 mm to 4 mm. The head 12 is preferably provided with bristles by means of conventional punching using anchor plates, but this may also be performed by means of the AFT (Anchor Free Tufting) or IMT (In-Mold Tufting) method. If the two last-mentioned methods are used, it is possible to produce area-like bristle clusters. The area-like base forms of the bristle clusters may in turn be configured in a way similar to the basic forms of the surface-area elements 30.

In the case of the embodiment in FIG. 26, preferably bristles 14B that are pointed at both ends are exclusively used. The bristles 14 combined in bristle clusters rise up virtually perpendicularly from the surface of the head 12. In this embodiment, the bristle holes 60 are arranged in such a way that there are never more than two center points of bristle holes 60 lying on a straight line. In the plan view of FIG. 26, the head 12 has an essentially rhombic basic form with rounded corners. In the free end region of the head 12, a group of 8 bristle clusters are configured as a set-apart group, while the bristle clusters in the region on the neck side are adapted in their arrangement to the outer contour of the head 12. On the head 12 configured in such a way, 28 to 38 bristle clusters, preferably 32 to 34 bristle clusters, are provided.

The head 12 represented in FIG. 26 has a thickness of 3 mm to 7 mm, preferably 4 mm to 6 mm. The maximum width of the head 12 is 9 mm to 17 mm, preferably 12 mm to 14 mm. The length of the bristle zone along the longitudinal axis of the head 12 is 13 mm to 26 mm, preferably 20 mm to 25 mm.

In the case of the variant for providing bristles that is shown in FIG. 27, bristle clusters with just cylindrical bristles 14A (colored black in the representation), which are together in a group of six and a group of four, are surrounded by further bristle clusters with pointed bristles 14B. The cylindrical bristles 14A are intended for surface-area cleaning in the oral cavity, while the pointed bristles 14B are intended in particular for cleaning interdental spaces. The height of the bristles 14 above the head 12 is 7 mm to 12 mm, preferably 8.5 mm to 9.5 mm, for the cylindrical bristles 14A, 8 mm to 14 mm, preferably 10.5 mm to 12.5 mm, for the pointed bristles 14B. As already mentioned, the diameter of the pointed bristles 14B is reduced to around 8 mm toward their free end. Over the remaining length to the head 12, the bristles 14B have an essentially constant diameter.

In FIGS. 28 to 34, two further embodiments of toothbrushes 10 are represented. They partially have a facet-like arrangement of surface-area elements 30 on the handle 18 and are provided with a tongue cleaner 57, as described above.

The toothbrush 10 represented in FIGS. 28 to 31 has in this case, by way of example, approximately rectangular surface-area elements 30 in the free end region of the handle 18, the element edges 38 that run in the longitudinal direction of the handle 18 coinciding with the tool parting line 40. It goes without saying that, as also in the previous configurational variants, the surface-area elements 30 may also be arranged on a larger portion of the surface.

The toothbrush 10 shown is preferably produced from three plastic components, the handle body 32 with the surface-area elements 30 preferably from a completely transparent material such as PET, with particular preference from PCT/PCTA/PCTG, or a semi-transparent or translucent hard material, preferably polypropylene PP. On the upper side 20 and the underside 22 of the toothbrush 10, the surface of the handle 18 is essentially formed by a soft material and/or a further hard material. The corresponding regions are provided with the reference numeral "62". A rosette- or crystal-like elevation 64 is arranged as a decorative element 47 in the free end region of the handle 18 and is preferably likewise formed from the additional soft or hard material of the region 62 surrounding it.

In particular when a completely transparent material with relatively high acquisition costs, such as PET or PCT/PCTA/PCTG, is used, it is advisable to provide translucent or opaque portions 62 of the volume or surface with a less expensive material. As already mentioned, it is possible in this respect to use hard or soft materials or a combination of the two, i.e. layers of hard and soft materials lying at least partially one on top of the other. Various material tests in the multi-component injection-molding process have shown that polypropylene PP is an ideal material for filling the portions 62 of the volume or surface that are not completely transparent. The use of PP in combination with a completely transparent material, in particular with PET or PCT/PCTA/PCTG, presents the following major advantages or requirements for a corresponding combination of materials:

1) Similar shrinkage behavior of the materials, i.e. PP and PET or PCT/PCTA/PCTG shrink similarly in the multi-component process, i.e. there is no or only insignificant formation of gaps in the boundary zone of the materials into which water or contaminants could penetrate. The plastics mentioned are partially crystalline plastics. The shrinkage lies in the range between 0.8% and 2.5%, preferably between 1% and 2%.
2) The materials have similar moduli of elasticity, i.e. PP and PET or PCT/PCTA/PCTG behave similarly if the handle 18 is bent under pressure during use. The modulus of elasticity for PP lies in the range between 1300 $N/mm^2$ and 1800 $N/mm^2$, that for the first component in the range from 1600 $N/mm^2$ to 2200 $N/mm^2$.

3) None of the materials has a tendency to undergo brittle fractures, i.e. the mentioned combination of materials PP and PET or PCT/PCTA/PCTG may also be used on thin, filigree geometrical elements, such as the neck 16 or the head 12, without the toothbrush breaking during use. This property is essential and allows, for example, a combination between styrene-containing, completely transparent hard materials, such as PS, SAN or ABS, and PP.
4) Good chemical resistance of the materials used: on account of the very good chemical resistance (for example to teeth cleaning agents, such as mouthwash, peppermint oil, isopropyl alcohol) of PP and PET or PCT/PCTA/PCTG, a combination of the materials can also be used in the head 12 and neck 16. This property is again essential and allows, for example, no combination between styrene-containing, completely transparent hard materials, such as PS, SAN or ABS, and PP in the neck 16 or head 12.
5) One of the materials is a polyolefin-based polar thermoplastic. Since PP is a polyolefin-based polar thermoplastic, there are a large number of soft materials, such as thermoplastic elastomers TPE, in particular with low Shore A hardnesses below 50, with preference below 30, that enter into a bond with PP during the multi-component injection molding, and consequently have excellent and durable adhesion to PP after the injection-molding process. Apart from the lower Shore A hardnesses that can be obtained for these TPEs, these TPEs are also much less expensive than TPEs that enter into a bond with completely transparent, less polar plastics, such as PET or PCT/PCTA/PCTG. In addition, a much better adhesive bond can be achieved between PP and TPEs that suit it and bond well with it.
6) The combination of materials allows at least part of the head 12 to consist of polypropylene PP. On account of the AFT bristle-providing method described further below, it may be of advantage to produce the AFT bristle carrier plate from PP. This carrier plate is undetachably joined to the head 12 by means of ultrasonic welding or some other suitable joining method. For this reason, it is of greatest advantage if the carrier plate and at least part of the head 12, in particular the joining locations (for example welding edge) between the head 12 and the carrier plate 72, consist of the same material, in particular of polypropylene. With this configurational variant, a major portion of the neck 16 or of the head 12 could then be produced from the completely transparent materials mentioned, without impairing the setting up of the connection with respect to the carrier plate.
7) One material can be processed at a much lower injection pressure than the other. In this context it should be mentioned that PP can be processed at a much lower injection pressure than PET or PCT/PCTA/PCTG or other completely transparent materials. The injection pressure (respectively dependent on the geometry of the molded part) of the first material component (PET or PCT/PCTA/PCTG) lies at 750 bar to 1000 bar. The injection pressure of the second material component (polypropylene PP) preferably lies in a range from 500 bar to 750 bar. This injection pressure of polypropylene PP together with a short holding pressure time is desirable in particular whenever some of the bristles 14 are encapsulated with it (for example in the In-Mold Tufting IMT method or if the AFT carrier plate is at least partially encapsulated for the setting up of the connection with respect to the handle 18). Otherwise, with excessive holding pressure times, the injection pressure that prevails can cause the position of the bristles to change undesirably.
8) The materials have different melting points and processing temperatures. In order that no washing away occurs in the multi-component injection molding, it is of advantage if the material used as the second material in the sequence has a lower processing temperature than the melting point of the first material used. Consequently, no material is washed away in the boundary area when the first, already solidified material component is encapsulated. The first material, PET or PCT/PCTA/PCTG, has a melting point in the range between 215° C. and 240° C. and a processing temperature in the range of 260° C. to 280° C. The second material, polypropylene, has a melting point in the range between 150° C. and 170° C. and a processing temperature of 190° C. to 230° C.

In this sense, the invention also provides the processing sequence for the toothbrush 10 according to the invention: A) injecting the completely transparent material, in particular PET or PCT/PCTA/PCTG, B) injecting PP, C) injecting a TPE that enters into an adhesive bond with PPG during the injection molding. An alternative sequence is not recommendable, since washing away or adhesive bonding problems may otherwise occur.

The only disadvantage that occurs with this combination of materials is that no bond is produced between PP and PET or PCT/PCTA/PCTG on account of the different material grouping and polarity during the multi-component injection-molding process, in the sense mentioned above. In this respect, it is necessary to produce a mechanical connection between undercuts, undetachable material bridges and positive or non-positive engagement on the basis of shrinkages of the polypropylene PP on the PET or PCT/PCTA/PCTG. These measures prevent the detachment of the PP material component even if the toothbrush is bent under compressive loading. This method is at least partially described in WO 00/34022 with respect to other materials.

Figure 37:
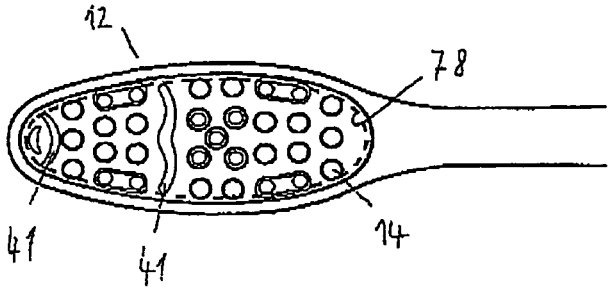
FIG. 37 shows a plan view of the head shown in FIG. 36, to which the carrier plate represented in FIG. 25 is fastened.
Figure 38:
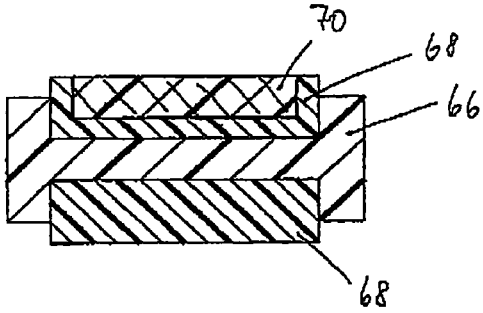
FIG. 38 shows a cross section of a plastic body in which a second hard component (polypropylene PP) (diagonal hatching when viewed in the prescribed manner from bottom right to top left) is provided on top of and underneath a first hard component (PET or PCT/PCTA/PCTG) (diagonal hatching when viewed in the prescribed manner from bottom left to top right) by means of an adhesive joint.

In FIGS. 38 and 39, two possible cross sections of plastic bodies that can be constructed with the combination of materials described above are represented by way of example and purely schematically. FIG. 38 shows a cross section in which a second hard component (polypropylene PP) 68 is provided on top of and underneath a first hard component (PET or PCT/PCTA/PCTG) 66. The anchoring of the two components 66, 68, which as described do not adhere directly to each other, is realized at another location in the longitudinal direction. One or more soft components 70 that adhesively bond to the second hard component (PP) 68 are applied to the second hard component 68. FIG. 37 shows a cross section through a further plastic body in which the first component 66 is mechanically anchored on one side to the second hard component 68. The mechanical anchorage is brought about, by way of example, by a dovetail joint. Soft material has in turn been applied to the second hard component.

The use of these combinations of materials is an essential partial aspect of the invention and can of course also be used without the surface-area elements 30.

Figure 35:
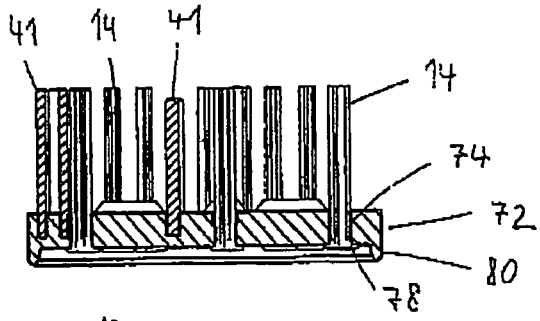
FIG. 35 shows a longitudinal section of a carrier plate covered with bristles and soft-elastic massaging and cleaning elements, which is intended for fastening to the head of a toothbrush according to the invention.
Figure 36:
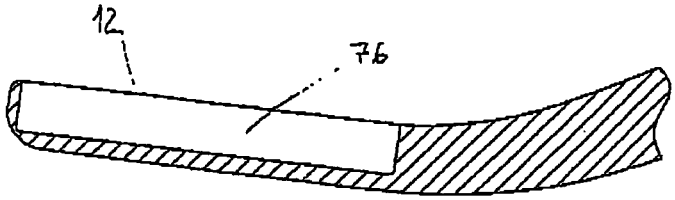
FIG. 36 shows a longitudinal section of a head of a toothbrush according to the invention, with a recess for receiving the carrier plate shown in FIG. 35.

In this embodiment of the toothbrush 10 according to the invention, the bristles are preferably provided by means of the mentioned AFT method, in which a separate carrier plate 72 with through-holes 74 is preferably produced by the one- or multi-component injection-molding process. The bristles 14 are subsequently pushed through the through-holes 74 and melted on the opposite side, in order to form a welding region in the form of a contiguous bed of bristle melt, which anchors the bristles 14, or the bristle clusters. The carrier plate 72 together with fastened bristles 14 and integrated soft-elastic massaging and cleaning elements 41 is represented in FIG. 35. In this representation, the melting of the ends of the bristles can be seen. After the anchoring of the bristles 14, the carrier plate 72 together with the bristles 14 is undetachably anchored in a corresponding, preferably exact-fitting, recess 76 in the head 12, in particular by means of ultrasonic welding. The described recess 76 in the head 12 is shown in the representation of FIG. 36. The carrier plate 72 is inserted into this recess 76 and anchored. The representation in FIG. 37 shows a plan view of the finished toothbrush 10 with attached carrier plate 72. The border of a previously mentioned welding region 78 in the recess in the head 12 is represented by dashed lines. The tip 80 that is provided on the carrier plate 72, running around the periphery, serves for welding the carrier plate 72 to the brush body. This takes place on the bottom of the recess. On account of the AFT method and the accompanying thinness of the walls of the head 12 and the AFT carrier plate 72 inserted therein, brittle materials should not be used. For this reason, the polypropylene PP that is already known in conjunction with the AFT method can be used, as described above, for setting up the connection between the head 12 and the carrier plate 72.

However, a completely transparent, non-brittle thermoplastic, such as PET or PCT/PCTA/PCTG, may alternatively also be used for the handle 18 and the carrier plate 72, and this is particularly preferred in conjunction with the invention. The setting up of the connection between the handle 18 and the carrier plate 72 is then of course also based on PET or PCT/PCTA/PCTG. Other, preferably non-brittle, for example styrene-containing thermoplastics that are flexibly bendable may also be used for this. When a transparent thermoplastic is chosen, the head 12 is formed at least partially with a non-polished surface, i.e. a surface provided with an eroding structure (increased surface roughness in comparison with the completely transparent surface). This achieves the effect that the bristle melt bed (welding region 78) caused by the AFT method is only indistinctly visible.

Rubber-elastic cleaning elements of soft material may be molded on the carrier plate 72. The soft material preferably enters into a bond with the completely transparent hard material during the encapsulation.

Figure 32:
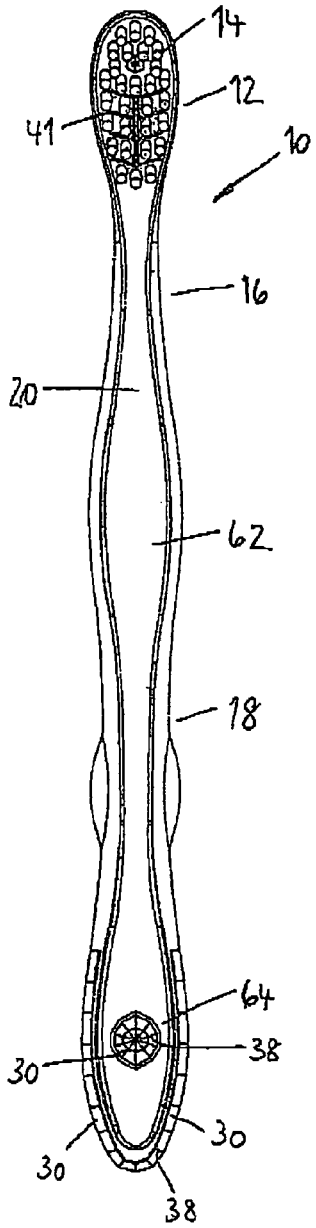
FIG. 32 shows a plan view of a further embodiment of a toothbrush according to the invention, likewise provided in certain portions of the free end region of the handle with a facet-like surface structure.
Figure 33:
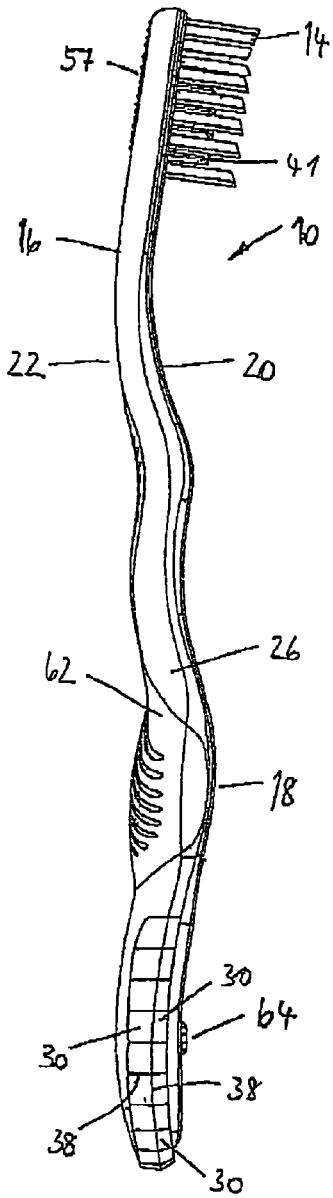
FIG. 33 shows a side view of the toothbrush shown in FIG. 32.
Figure 34:
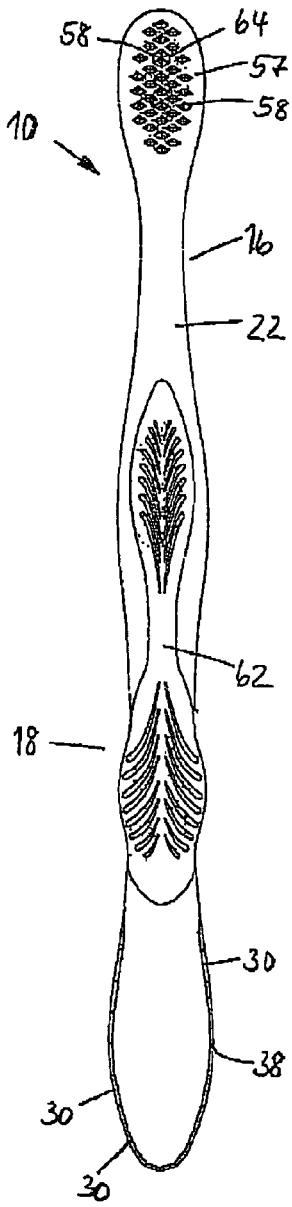
FIG. 34 shows a view from below of the toothbrush shown in FIG. 32 and FIG. 33.

In FIGS. 32 to 34, an embodiment similar to the embodiment shown in FIGS. 28 to 31 is represented.

As a difference from the previously described toothbrush 10, here the basic body of the toothbrush 10, as well as the elevation 64, is produced from a transparent hard material, preferably from SAN, PS, ABS, PET or PCT/PCTA/PCTG. Regions 62 of a soft material are in turn formed on the upper side 20 and the underside 22. The bristles are provided in this embodiment by the conventional punching method by means of anchor plates. Since less thin-walled elements are provided in the head 12 in the case of this conventional bristle-anchoring method, more brittle, completely transparent thermoplastics, such as PS, ABS or SAN, may also be used.

The two embodiments represented in FIGS. 28 to 34 are also provided with further rosette- or crystal-like elevations 64 in the head region. They rise up both on the upper side 20, where they interrupt the bristle zone, and on the underside 22. The elevations 64 on the upper side 20 and the underside 22 preferably lie directly one above the other and form a monolithic surround of a transparent or translucent material. With the exception of the rosette-like elevations 64 on the upper side 20 of the head 12, the remaining region on this side is completely covered with a layer of soft material.

In the bristle zones of the two last-mentioned embodiments of toothbrushes 10, already mentioned cleaning or massaging elements 41 of soft material may be additionally arranged (see FIG. 32 and FIG. 33). A tongue cleaner 57 of hard and/or soft material is respectively formed on the underside 22 of the head 12. The tongue cleaner 57 may be provided with decorative elements 47, as for example previously described with a crystal-like elevation 64 of surface-area elements 30.

All the described embodiments of handles 18 with surface-area elements 30 may not only be used on a manual or electric toothbrush 10 but alternatively also on other oral hygiene products, such as tongue cleaners or interdental brushes, or on other personal care products, such as hairbrushes, mascara brushes, powder brushes, cosmetic brushes in the general sense, wet razors and other personal care and oral hygiene devices that are provided with a treatment head. Use is likewise possible in the case of domestic brushes, such as mops, mop pans or washing brushes.

As already mentioned, apart from forming the handle 18 as a solid body, an embodiment as a hollow body is likewise possible. The material used in this case is in turn preferably transparent, whereby a view into the hollow space is afforded, possibly with visual distortions. In this case, the hollow space that preferably lies in the interior of the handle 18 may be used for receiving electronic and/or mechanical elements, such as for example batteries and drive systems for conventional electric toothbrushes or vibrational or acoustic toothbrushes. The hollow space is preferable covered by an additional end cap or a cover.

The surface-area elements 30 are preferably also used to achieve visual effects in connection with an active light source inside or outside the toothbrush 10. In this case, the surface-area elements 30 may serve as reflectors or light distributors. For this purpose, light may, for example, be conducted into the head 12 from an LED in the handle 18 or from one location in the handle 18 to another. Furthermore, it is possible to configure a manual toothbrush 10 with a hollow space in the handle 18 that can be used for accommodating elements of any kind, for example toothpaste tubes.

As already mentioned, a toothbrush 10 according to the invention is preferably produced in an injection-molding process. The entry of the polymer takes place on the underside 22 of the toothbrush 10 via a gating point in the facet-like arrangement, either on a surface-area element 30 or preferably on an element edge 38. The gating point lies 7 mm to 16 mm, preferably 8 mm to 14 mm, away from the free end of the handle 18 on the longitudinal center axis of the toothbrush 10.

To eject a hardened toothbrush 10 from an injection molding tool, 2 to 4, preferably 2, ejectors are arranged on the latter. The ejectors press the hardened product out of the halves of the injection-molding tool, preferably at smooth, edge-free locations, preferably in the region of the neck 16 and in the region of the narrowed front handle part 42 of the toothbrush 10.

The provision of decorative elements 47 on the toothbrush 10 is performed in a further working step, preferably directly on a spraying or stamping machine, by spraying on one or more further hard and/or soft materials. However, the decorative elements 47 may also be an integral part of the hard component and be formed in the same operation as the hard or soft component of the handle 18.

It goes without saying that the individual figures and descriptions can be combined with one another and the elements described can be placed elsewhere on the product without departing from the scope of the invention.

The invention claimed is:

1. A toothbrush with an elongate handle, a neck adjoining the elongate handle on one side and a head arranged on the neck opposite from the elongate handle, a surface of the elongate handle being provided with at least approximately planar surface-area elements, which are respectively arranged adjacent one another and directly adjoin one another to form element edges, wherein the elongate handle has at least in certain portions a multiplicity of the at least approximately planar surface-area elements, which are arranged on the surface in a facet-like manner and have a base area with a maximum extent of 0.2 mm to 8 mm, and thereby approximately form an essentially rounded basic form of the elongate handle, and the element edges adjoining one another form a contiguous edge line, which wraps spirally around the handle.

2. The toothbrush as claimed in claim 1, wherein portions with the surface-area elements are adjacent to portions with a continuously smooth surface.

3. The toothbrush as claimed in claim 2, wherein the portions with the surface area elements and the portions with the continuously smooth surface completely or partially surround one another.

4. The toothbrush as claimed in claim 1, wherein the surface-area elements are formed essentially in a rear third of the toothbrush on a side with the elongate handle.

5. The toothbrush as claimed in claim 1, wherein, with all the surface-area elements, a ratio of an extent in a longitudinal direction of the elongate handle to an extent in a circumferential direction of the elongate handle is less than 5:1.

6. The toothbrush as claimed in claim 1, wherein the surface-area elements have a polygonal, circular, elliptical or triangular base area or a base area made up of polygonal, circular, elliptical or triangular basic elements.

7. The toothbrush as claimed in claim 1, wherein the surface of the elongate handle has surface-area elements with a same single basic form or surface-area elements with a same first basic form and surface-area elements with a same second basic form.

8. The toothbrush as claimed in claim 7, wherein the surface of the elongate handle further has surface area elements of a complementary basic form.

9. The toothbrush as claimed in claim 1, wherein a size and/or a number of surface-area elements is scaled with a circumferential length of the elongate handle at the respective position of the surface-area elements.

10. The toothbrush as claimed in claim 1, wherein the surface-area elements form, on the surface of the elongate handle, a Briolette cut, in which a respective element edge of the surface-area elements is oriented at right angles to a longitudinal axis of the elongate handle.

11. The toothbrush as claimed in claim 1, wherein the toothbrush is produced in an injection-molding process and the surface-area elements on a production-induced tool parting line are made smaller or with a different basic form, all the surface-area elements adjacent the production-induced tool parting line being arranged at an angle to one another.

12. The toothbrush as claimed in claim 11, wherein the element edges run on the production-induced tool parting line.

13. The toothbrush as claimed in claim 1, wherein a tool parting line forms a contiguous edge line.

14. The toothbrush as claimed in claim 1, wherein individual surface-area elements are at least partially covered with a soft material, roughened and/or coated with a metal or a dye.

15. The toothbrush as claimed in claim 1, wherein regions around the element edges are at least partially formed from a soft material.

16. The toothbrush as claimed in claim 1, wherein the elongate handle is formed at least in certain portions in an essentially ellipsoidal manner.

17. The toothbrush as claimed in claim 1, wherein the elongate handle is provided with a thumb rest with a rosette-like depression, which has surface-area elements.

18. The toothbrush as claimed in claim 1, wherein the head is provided on an underside, opposite from an upper side covered with bristles, with a tongue cleaner, which has tongue cleaning elements with base areas having a same shape of the surface-area elements of the handle.

19. The toothbrush as claimed in claim 1, wherein a light source, a light of which is deflected and/or distributed via the surface-area elements, is arranged on the elongate handle.

20. The toothbrush as claimed in claim 1, comprising a hollow space, which is at least partially delimited by the surface-area elements.

21. A toothbrush with an elongate handle, a neck adjoining the elongate handle on one side and a head arranged on the neck opposite from the elongate handle, a surface of the elongate handle being provided with at least approximately planar surface-area elements, which are respectively arranged adjacent one another and directly adjoin one another to form element edges, wherein the elongate handle has at least in certain portions a multiplicity of the at least approximately planar surface-area elements, which are arranged on the surface in a facet-like manner and thereby approximately form an essentially rounded basic form of the elongate handle, wherein, at least in the certain portions, sectional lines through surface-area elements run periodically concave-convex in a longitudinal sectional plane in which a longitudinal axis of the elongate handle likewise lies.

22. A toothbrush with an elongate handle, a neck adjoining the elongate handle on one side and a head arranged on the neck opposite from the elongate handle, a surface of the elongate handle being provided with at least approximately planar surface-area elements, which are respectively arranged adjacent one another and directly adjoin one another to form element edges, wherein the elongate handle has at least in certain portions a multiplicity of the at least approximately planar surface-area elements, which are arranged on the surface in a facet-like manner and thereby approximately form an essentially rounded basic form of the handle, wherein surface normals of adjacent surface-area elements in a middle handle portion with respect to a longitudinal axis of the elongate handle enclose angles of between 1° and 30° , and surface normals of adjacent surface-area elements in a free end region of the elongate handle enclose angles of between 20° and 50°.

* * * * *